US011732387B2

(12) United States Patent
Aleman et al.

(10) Patent No.: US 11,732,387 B2
(45) **Date of Patent: *Aug. 22, 2023**

(54) TRIM PIECE WITH VARIABLE STRETCH CHARACTERISTICS

(71) Applicant: NIKE, Inc., Beaverton, OR (US)

(72) Inventors: Demetrio Aleman, Costa Mesa, CA (US); Bruce Y. Moore, Laguna Beach, CA (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/574,323

(22) Filed: Jan. 12, 2022

(65) Prior Publication Data

US 2022/0136142 A1 May 5, 2022

Related U.S. Application Data

(63) Continuation of application No. 16/853,537, filed on Apr. 20, 2020, now Pat. No. 11,255,029.

(Continued)

(51) Int. Cl.
*A41F 9/02* (2006.01)
*D03D 3/00* (2006.01)

(Continued)

(52) U.S. Cl.
CPC ..... *D03D 3/005* (2013.01); *A41D 27/08* (2013.01); *A41F 9/02* (2013.01); *D03D 15/56* (2021.01);

(Continued)

(58) Field of Classification Search
CPC .... A41F 9/025; A41F 9/02; A41F 1/00; A41F 9/00; A41D 2300/33; A41D 7/005;

(Continued)

(56) References Cited

U.S. PATENT DOCUMENTS 76,871 A * 4/1868 Wolfsbruck ..... A41D 1/21 2/221
503,520 A * 8/1893 Bennet ..... A61F 13/496 2/400

(Continued)

FOREIGN PATENT DOCUMENTS

| | | |
|---|---|---|
| CN | 201447540 U | 5/2010 |
| CN | 104918510 A | 9/2015 |
| DE | 410103.0 C | 2/1925 |

OTHER PUBLICATIONS

Board Shorts, Men, Surf & Swimwear, Hurley, Available online at: <https://www.hurley.com/collections/men-surf-swimwear-board-shorts>, Accessed on Jun. 18, 2020, 4 pages.

(Continued)

*Primary Examiner* — Robert H Muromoto, Jr.
(74) *Attorney, Agent, or Firm* — Shook, Hardy & Bacon, LLP

(57) ABSTRACT

Elastic trims and articles incorporating the same, and also methods of manufacturing and processing elastic trims and articles incorporating the same, are provided. An elastic trim may include a base textile that is knitted or woven, and may further include cables that are movably positioned in tunnel structures located within the base textile, the cables having a lower stretch characteristic than the base textile. The cables may be secured and removed at certain locations, thereby imparting a variable stretch characteristic to the elastic trim. The elastic trims may be incorporated into various articles, including waistbands, apparel, footwear, and bags.

20 Claims, 18 Drawing Sheets

Related U.S. Application Data

(60) Provisional application No. 62/854,787, filed on May 30, 2019.

(51) Int. Cl.
*A41D 27/08* (2006.01)
*D03D 1/00* (2006.01)
*D03D 15/56* (2021.01)

(52) U.S. Cl.
CPC .... *D10B 2501/043* (2013.01); *D10B 2501/06* (2013.01)

(58) Field of Classification Search
CPC .... A41D 13/1254; A41D 31/18; D04B 21/18; D04B 21/20
See application file for complete search history.

(56) References Cited

U.S. PATENT DOCUMENTS 898,511 A * 9/1908 Schneider ..... A41D 1/21 2/221
1,561,712 A * 11/1925 Goldsmith ..... A41D 1/08 2/23
1,825,271 A * 9/1931 Karberg ..... A41F 9/025 2/237
2,349,019 A * 5/1944 Terrell ..... A41F 9/025 2/221
5,375,266 A * 12/1994 Crisco ..... A41F 9/025 2/243.1
6,286,341 B2 * 9/2001 Jackson, Jr. ..... D04B 21/20 2/221
9,295,293 B2 * 3/2016 Rosenhaus ..... A41D 1/14
10,368,590 B2 * 8/2019 Diaz ..... A41C 3/0085
10,455,877 B2 * 10/2019 Moore ..... A41F 9/025
11,255,029 B2 * 2/2022 Aleman ..... D03D 3/005
2002/0099345 A1 * 7/2002 Saito ..... A41D 13/1254 604/358
2012/0036614 A1 * 2/2012 Meschter ..... A41D 7/005 2/228
2013/0145652 A1 6/2013 Podhajny et al.
2014/0237861 A1 8/2014 Podhajny
2014/0245632 A1 9/2014 Podhajny et al.
2014/0331385 A1 * 11/2014 Okies ..... A41D 1/06 2/235
2015/0152578 A1 * 6/2015 Darby ..... A41F 9/00 66/171
2015/0189935 A1 * 7/2015 Rosenhaus ..... A41D 27/20 2/74
2015/0327607 A1 * 11/2015 Rosenhaus ..... A41D 27/20 2/74
2015/0359290 A1 12/2015 Podhajny et al.
2016/0262478 A1 * 9/2016 Moore ..... A41F 9/00
2017/0258159 A1 * 9/2017 Moore ..... A41D 7/005
2017/0325531 A1 * 11/2017 Lomax ..... A41F 9/025
2019/0119836 A1 * 4/2019 Darby ..... A41F 9/00
2020/0378040 A1 12/2020 Aleman et al.

OTHER PUBLICATIONS

Hurley Phantom Hyperweave, Men's 18" Board Shorts, Nike, Inc., Available online at: <https://www.nike.com/t/hurley-phantom-hyperweave-mens-18-board-shorts-XMptDj/890781-395>, Accessed on Jun. 18, 2020, 5 pages.
Office Action received for European Patent Application No. 20734453.2, dated Jun. 5, 2023, 4 pages.

* cited by examiner

TRIM PIECE WITH VARIABLE STRETCH CHARACTERISTICS

CROSS-REFERENCE TO RELATED APPLICATIONS AND PRIORITY CLAIM

This application is a continuation of U.S. patent application Ser. No. 16/853,537, filed Apr. 20, 2020, and titled "Trim Piece with Variable Stretch Characteristics," which claims priority to U.S. Provisional Patent App. No. 62/854,787, filed May 30, 2019, and titled "Trim Piece with Variable Stretch Characteristics." The entire contents of each of the aforementioned applications is incorporated herein by reference.

TECHNICAL FIELD

The field relates to trim pieces as well as methods of manufacturing and processing the same.

BACKGROUND

Trim pieces are often incorporated into articles of apparel to provide a particular structural characteristic. For example, a trim piece may be integrated into an article of apparel to introduce a form-fitting layer at a particular location. The incorporation of the trim piece also allows the characteristics of the materials used to form the trim piece to be imparted to the article of apparel.

BRIEF DESCRIPTION OF THE DRAWINGS

Illustrative aspects are described in detail herein with reference to the attached drawing figures, which are incorporated herein by reference and which are intended to depict non-limiting aspects of the present disclosure, wherein.

DETAILED DESCRIPTION

Figure 1:
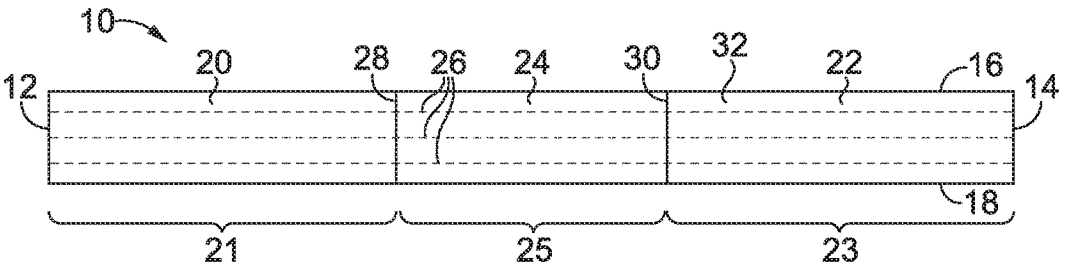
FIG. 1 depicts an elevation view of an elastic trim, in accordance with an aspect hereof.

The subject matter of this disclosure is described with specificity herein to meet statutory requirements. However, the description is not intended to limit the scope of the disclosure. It is instead contemplated that the disclosed or claimed subject matter might also be embodied in other ways, to include different features and/or steps, or combinations of features and/or steps, similar to the ones described in this disclosure, and in conjunction with other present or future technologies. Moreover, although the terms "step" and/or "block" may be used throughout this disclosure to describe different elements of methods employed, the terms should not be interpreted as implying any particular order among or between various steps or blocks unless the order is explicitly stated and required.

In brief, and at a high level, this disclosure describes, among other things, elastic trims and articles incorporating the same, and also, methods of manufacturing and processing elastic trims and articles incorporating the same.

The elastic trims described herein may be formed from a variety of different materials and constructions that provide variable stretch characteristics. For example, the elastic trims described herein may be knitted or woven. The materials used to construct the elastic trims described herein may include yarns, threads, fibers, cords, strands, cables, textiles, and/or other materials, which may be synthetic and/or natural, and which may exhibit elastomeric, partially elastomeric, or non-elastomeric properties in different contemplated aspects and portions thereof.

In one aspect, an elastic trim includes a base textile. The base textile may be formed from materials that impart a stretch characteristic to the base textile, e.g., one or more elastomeric yarns, filaments, and/or fibers. The base textile further includes one or more tunnel structures therein that extend along at least part of a length of the elastic trim. The elastic trim includes cables movably positioned in each tunnel structure. The cables may be selected and/or formed to exhibit lower elastomeric properties than the materials forming the base textile, or in other words, the base textile may be formed to exhibit a higher stretch characteristic than the cables positioned in the tunnel structures of the elastic trim. The integration of the comparably lower-stretch cables allows, through further processing, for variable stretch characteristics to be imparted along a length of the elastic trim.

The elastic trims described herein may initially be manufactured or otherwise provided as a length of elastic trim that includes a plurality of repeating sections integrally formed with each other. In such aspects, each repeating section may represent an elastic trim aspect as described herein. The repeating sections may be individually removed from the length of trim and processed to impart the variable stretch characteristics described herein. The processed elastic trims may further be incorporated or formed into different articles (e.g., waistbands, upper body articles of apparel, lower body articles of apparel, footwear, bags and equipment, and the like), providing, as a result, a structure that imparts adaptable stretch, flexibility, and securement to the articles, in addition to other benefits. Further examples and descriptions of the aforementioned aspects are provided below with reference to FIGS. 1-19.

In one aspect hereof, an elastic trim is provided. The elastic trim includes a first woven section forming a first longitudinal length of the elastic trim, a second woven section forming a second longitudinal length of the elastic trim, and a third woven section forming a third longitudinal length of the elastic trim, the third woven section interposed between the first woven section and the second woven section, the first woven section and the second woven section integrally extending from opposite ends of the third woven section. The elastic trim further includes at least one tunnel structure extending through the first woven section, the second woven section, and the third woven section, and a cable movably positioned within the at least one tunnel structure. The first woven section and the second woven section each comprise a first woven layer, a second woven layer, and a third woven layer that are interwoven with each other at one or more first areas.

In another aspect hereof, an elastic trim is provided. The elastic trim includes a first section forming a first longitudinal length of the elastic trim, a second section forming a second longitudinal length of the elastic trim, and a third section forming a third longitudinal length of the elastic trim, the third section interposed between the first section and the second section, the first section and the second section integrally extending from opposite first and second ends of the third section. The elastic trim further includes a first tunnel structure extending through the first section with a first cable movably positioned within the first tunnel structure, and a second tunnel structure extending through the second section with a second cable movably positioned within the second tunnel structure. The first cable terminates and is secured at the first end of the third section and the second cable terminates and is secured at the second end of the third section, and a first end of the first section and a first end of the second section are coupled together such that the elastic trim forms a continuous circumference.

In another aspect hereof, a method of processing a length of elastic trim is provided. The method includes securing a first end of the length of elastic trim to an opposite second end of the length of elastic trim to form a continuous circumference. The length of elastic trim includes at least one tunnel structure, and a cable movably positioned within the at least one tunnel structure. The method further includes securing the cable at a first location and at a second location, where the first location and the second location correspond respectively to a first end and a second end of a first longitudinal length of the continuous circumference, and removing a length of the cable that extends between the first location and the second location.

Positional terms as used herein such as "inner-facing," "outer-facing," "top," "bottom," and the like are to be given their common meaning with respect to an example elastic trim being incorporated into an apparel item worn by a hypothetical wearer standing in an upright position. The term "trim" as used herein, may comprise any type of material piece that can be secured to an apparel item in, for instance, a processing and/or a post-processing step. Example elastic trims may comprise, for instance, waistbands on shorts, pants, or shirts, under-bands on bras or support garments, wrist cuffs, ankle cuffs, collars, and the like. Further, as used in this disclosure, terms such as "affixing," "coupling," "securing," and the like may mean releasably attaching or permanently attaching two or more elements together (e.g., a waistband to a short or pant, an under-fband to a bra or top, and the like). Elements may be releasably attached using, for instance, zippers, sliders, buttons, hooks, snaps, hook-and-loop fasteners, releasable adhesives, and the like. Elements may be permanently attached using, for instance, stitching, bonding, welding, laminates, adhesives, and the like.

The term "integrally woven" as used herein may mean a woven textile having, for example, a warp yarn from a first area of the woven textile extending into or through a second area of the woven textile. Additionally, the term "integrally woven" may also mean a woven textile having, for example, a weft yarn from a first area of the woven textile extending into or through a second area of the woven textile. The term "integrally knit" as used herein may mean a knit textile having a yarn from one or more knitted courses in a first area being interlooped with one or more knitted courses of another area. The interlooping may be through a simple knit stitch, a tuck stitch, a held stitch, a float or miss stitch, and the like.

Turning now to FIG. 1, an elastic trim 10 is provided, in accordance with an aspect hereof. The elastic trim 10 includes a first end 12 and a second end 14 that are spaced apart in a longitudinal direction of the elastic trim 10. The elastic trim 10 also includes a first edge 16 and a second edge 18 that are spaced apart in a transverse direction of the elastic trim 10. For the purposes of this description, a "length" of elastic trim is defined as the longitudinal length of the elastic trim, i.e., a length measured in the longest direction, i.e., from end-to-end, and a "width" of the elastic trim is defined as the transverse distance of the elastic trim, i.e., a distance measured in the shortest direction, i.e., from top-to-bottom. For example, the "length" of the elastic trim 10 shown in FIG. 1 refers to the distance measured between the first end 12 and the second end 14 (i.e., in the longitudinal direction), and the "width" of the elastic trim 10 shown in FIG. 1 refers to the distance measured between the first edge 16 and the second edge 18 (i.e., in the transverse direction).

The elastic trim 10 shown in FIG. 1 includes a first section 20 that defines a first longitudinal length 21 of the elastic trim 10, a second section 22 that defines a second longitudinal length 23 of the elastic trim 10, and a third section 24 that defines a third longitudinal length 25 of the elastic trim 10. The first, second, and third sections 20, 22, 24 of the elastic trim 10 are integrally formed with each other (e.g., are integrally woven and/or are integrally knitted together). The three sections 20, 22, 24 extend in sequence along the elastic trim 10. The first section 20 integrally extends from a first end 28 of the third section 24, and the second section 22 integrally extends from a second end 30 of the third section 24. With the aspect shown in FIG. 1, the third longitudinal length 25 is less than the first longitudinal length 21 and the second longitudinal length 23. However, it is contemplated that in other aspects, each of the sections 20, 22, 24 may extend a different longitudinal length, including equal longitudinal lengths.

The elastic trim 10 shown in FIG. 1 includes a base textile 32. The base textile 32 is constructed to exhibit a stretch characteristic (i.e., exhibit elastomeric properties). The base textile 32 may be formed from a variety of materials and/or constructions that provide the aforementioned stretch characteristic. For example, the base textile 32 may be formed from one or more yarns, threads, fibers, cords, strands, textiles, and the like, at least some of which exhibit elastomeric properties to impart a stretch characteristic to the base textile 32. These materials forming the base textile 32 may be woven or knitted in different aspects. The base textile 32 may exhibit a two-way stretch characteristic or a four-way stretch characteristic in different aspects. The base textile 32 may be formed of one single, integral layer, or may be formed from a multi-layer construction in different aspects.

The elastic trim 10 shown in FIG. 1 further includes a plurality of tunnel structures 26 extending longitudinally along the elastic trim 10, and in particular, longitudinally along the base textile 32. The tunnel structures 26 extend between the first end 12 and the second end 14 of the elastic trim 10 in generally parallel fashion in the example aspect shown in FIG. 1. Depending on the construction of the base textile 32, the tunnel structures 26 may be integrally formed with the materials used to construct the base textile 32, and/or the tunnel structures 26 may be formed by the spaces provided between adjacent layers of material that are assembled together to form the base textile 32, in different aspects. FIG. 1 depicts the elastic trim 10 having three tunnel structures 26 therein for example purposes. However, in other contemplated aspects, more or fewer tunnel structures may also be formed in the elastic trim 10, and in particular, in the base textile 32.

The tunnel structures 26 present in the elastic trim 10 may each include a cable movably positioned therein. The cables are not depicted in the aspect shown in FIG. 1 due to the tunnel structures 26 themselves covering the cables, but example cables are shown in reference to other figures herein. In addition, with respect to the elastic trim 10 depicted in FIG. 1, the cables may be visible in alternative aspects in which the tunnel structures 26 include openings exposing the cables. Continuing with FIG. 1, the cables may be positioned in the corresponding tunnel structures 26 during a process of manufacturing the elastic trim 10. For example, as the base textile 32 is knitted or woven, the cables may be separately and/or simultaneously fed into the tunnel structures 26, such that they are movably positioned therein.

The cables included in the elastic trim 10 may be formed of material(s) and/or construction(s) that allow the cables to exhibit lower elastomeric properties, i.e., lower stretch characteristics, than the materials that form the base textile 32, which exhibits a stretch characteristic. For example, the cables may be formed of a non-stretch or substantially non-stretch material, such as one that includes one or more yarns, threads, fibers, strands, cords, and the like, exhibiting, for example, less than 1, 2, 3, 4, 5, or 10 percent stretch, while the materials of the base textile 32 exhibit at least some additional amount of stretch. In other words, the base textile 32 in the aspect depicted in FIG. 1 exhibits at least a first stretch characteristic, and the cables positioned in the tunnel structures 26 exhibit at least a second stretch characteristic, where the second stretch characteristic is less than the first stretch characteristic.

The cables described herein may be formed of a natural material, filament, and/or fiber; a synthetic material, filament, and/or fiber; a polymeric material, filament, and/or fiber; and/or a metal material, filament, and/or fiber, in contemplated aspects. The cables and the tunnel structures 26 may have relative sizes that permit the cables to move within the tunnel structures 26. For example, the relative sizes of the cables and the tunnel structures 26 may result in a friction fit that allows the cables to slide relative to the tunnel structures when an amount of force is applied to the cables to impart a sliding motion thereto (i.e., overcoming the coefficient of static friction). As another example, each tunnel structure 26 may be larger in diameter than its corresponding cable by some degree (e.g., 0.1, 0.5, 1, 2, 3, 4, 5, 10, or 20 percent larger), thereby allowing the cable to slide within the tunnel structure 26 due to the tolerance existing between the elements.

The elastic trim 10 shown in FIG. 1 may include variable stretch properties along its longitudinal length. This can be provided through different constructions of the elastic trim 10 and/or different processing of the elastic trim 10. For example, in one example process, the elastic trim 10 is removed, e.g., cut out, from a length of trim having multiple repeating sections (e.g., the length of trim 36 with repeating sections 34 shown in FIGS. 2A and 2B). The removed elastic trim 10 may then be processed to impart different stretch characteristics along its longitudinal length. For example, the cables incorporated into the tunnel structures 26 may be secured (e.g., stitched, adhered, welded, tacked, and the like) at the first end 12 and at the second end 14 of the elastic trim 10 to restrict their movement at those locations. The cables may additionally be secured at the first end 28 and the second end 30 of the third section 24 of the elastic trim 10 to restrict their movement at those locations. Following this, the cables extending through the tunnel structures 26 located in the third section 24 may be removed (e.g., exposed and cut out). As a result of this process, the first section 20 of the elastic trim 10 includes the cables movably positioned in the tunnel structures 26 thereof, allowing them to impart a non-stretch or reduced stretch characteristic to the first section 20 relative to the base textile 32, and the second section 22 of the elastic trim 10 includes the cables movably positioned in the tunnel structures 26 thereof, allowing them to impart a non-stretch or reduced stretch characteristic to the second section 22 relative to the base textile 32. The third section 24 of the elastic trim 10 includes the base textile 32 without the cables located in the tunnel structure 26 thereof, i.e., the cables terminate at the first end 28 and the second end 30, and as a result the third section 24 exhibits increased stretch characteristics relative to the first section 20 and the second section 22 of the elastic trim 10.

Figure 2A:
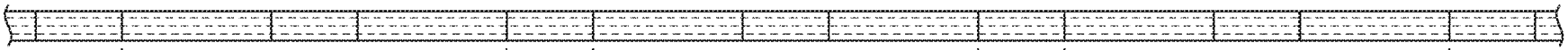
FIG. 2A depicts an elevation view of a length of elastic trim having a plurality of repeating sections that each correspond to the elastic trim of FIG. 1, in accordance with an aspect hereof.
Figure 2B:
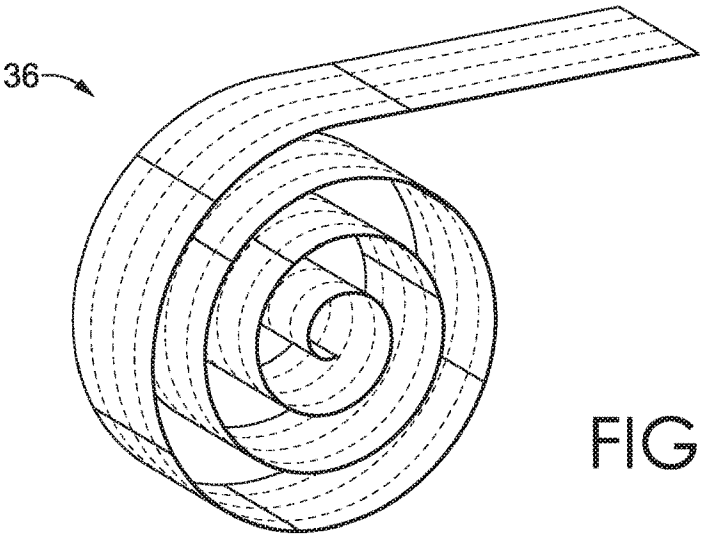
FIG. 2B depicts the length of elastic trim shown in FIG. 2A, presented in rolled form, in accordance with an aspect hereof.

Referring now to FIGS. 2A and 2B, an elastic trim 36 having a plurality of repeating sections 34, each of which corresponds to the elastic trim 10 shown in FIG. 1, is provided, in accordance with an aspect hereof. FIG. 2A shows the elastic trim 36 and the plurality of repeating sections 34 in elongated form. FIG. 2B shows the elastic trim 36 in rolled form as may occur, for example, when shipping, transporting, or storing the elastic trim 36. As shown in FIG. 2A and in FIG. 2B, the plurality of repeating sections 34 are integrally formed with each other, forming a repeating sequence of some particular length. The plurality of repeating sections 34 each represent a pre-processed and/or partially processed elastic trim that can be removed and further processed. In this sense, the aspects shown in FIGS. 2A and 2B depict how multiple elastic trims may be manufactured in sequence, separated, and then processed for use in various articles as described further below.

Figure 3A:
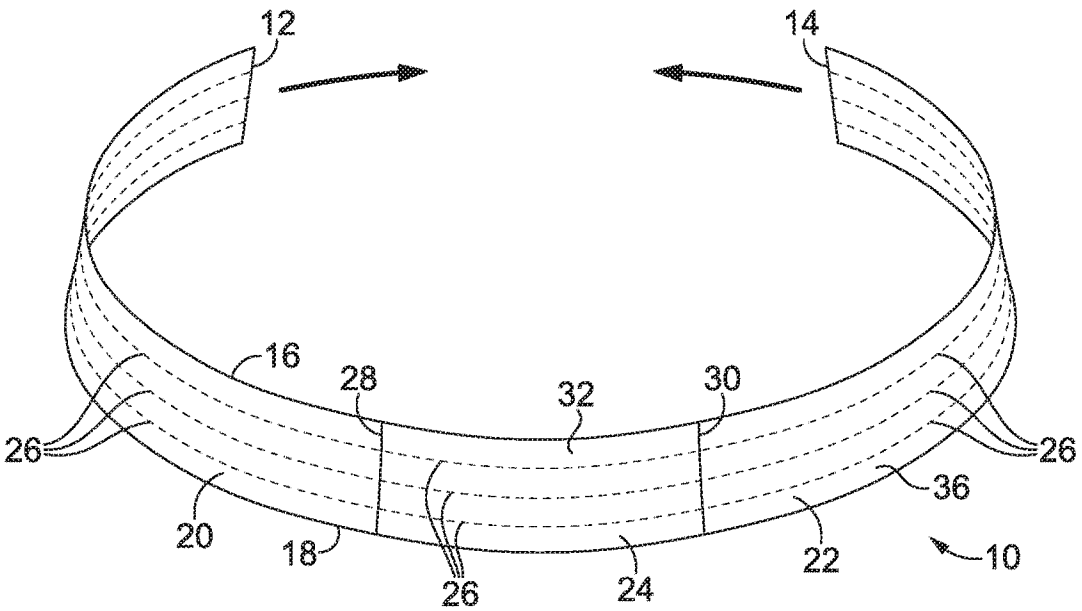
FIG. 3A depicts the elastic trim of FIG. 1 being formed into a continuous circumference, in accordance with an aspect hereof.
Figure 3B:
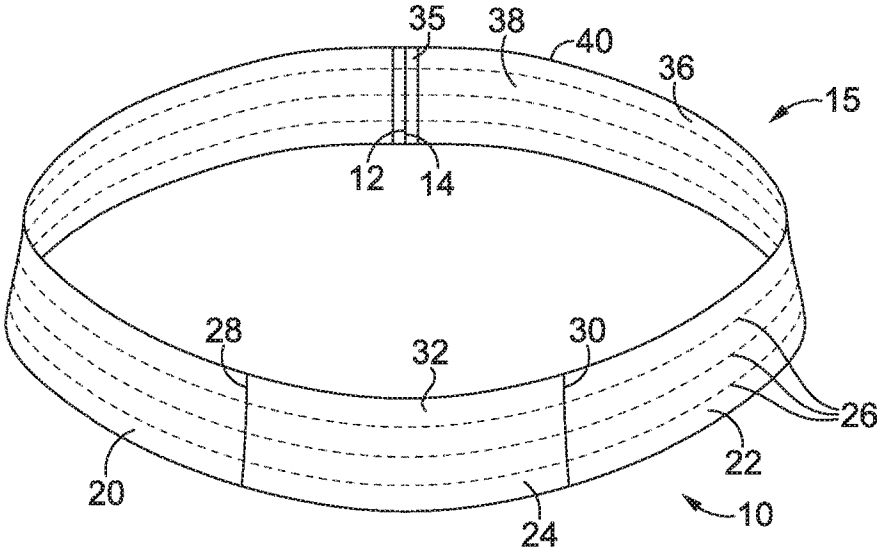
FIG. 3B depicts the elastic trim of FIG. 3A secured in the continuous circumference, in accordance with an aspect hereof.

Referring to FIGS. 3A-3B, the elastic trim 10 of FIG. 1 is shown being formed into a continuous circumference and secured, in accordance with an aspect hereof. FIG. 3A depicts the elastic trim 10 being modified so that the first end 12 and the second end 14 are brought together. FIG. 3B shows the first end 12 and the second end 14 placed in contact and secured, forming a continuous circumference 15. The first end 12 and the second end 14 may be secured with different methods to achieve the attachment shown in FIG. 3B. For example, the first and second ends 12, 14 may be stitched, adhered, welded, and/or attached to each other using a coupling element, such as an overlay 35 as shown in FIG. 3B. The overlay 35 may be sized to overlay a portion of an inside surface 38 of the elastic trim 10, a portion of the outside surface 40 of the elastic trim 10, or a portion of both the inside surface 38 and the outside surface 40 of the elastic trim 10, in contemplated aspects. The overlay 35 may be, for example, a heat-activated seam tape that is placed over the adjoined first and second ends 12, 14 and then heated to bond it to the base textile 32, thereby securing the first end 12 and the second end 14 together (additional stitching may be utilized in such an aspect).

Further, as described herein, the elastic trim 10 may be processed to impart variable stretch characteristics along the longitudinal length of the elastic trim 10. It should be noted that this can occur at different stages of manufacturing and processing. For example, for the elastic trim 10, the imparting of variable stretch characteristics may occur at a stage shown in FIG. 1, or the stage shown in FIG. 3B, or at another stage of processing, in contemplated aspects.

Figure 4A:
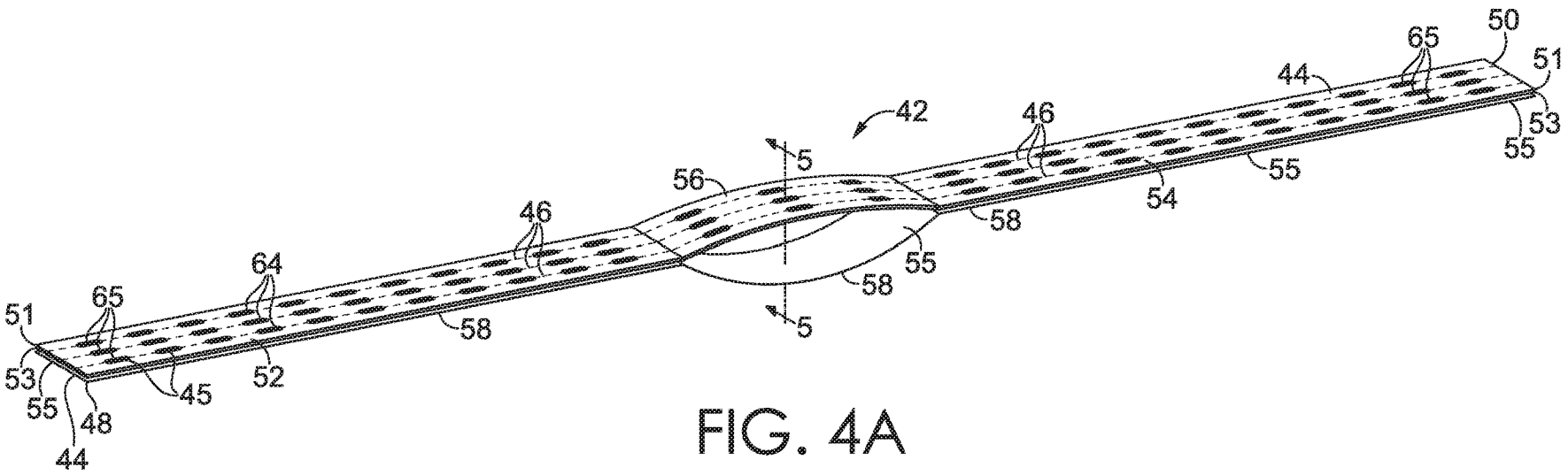
FIG. 4A depicts a perspective view of a woven elastic trim, in accordance with an aspect hereof.

Referring now to FIG. 4A, an elastic trim 42 formed from a woven construction is shown, in accordance with an aspect hereof. The elastic trim 42 shown in FIG. 4A includes, like the elastic trim 10 shown in FIG. 1, a base textile 44 formed from one or more woven materials that impart a stretch characteristic to the base textile 44. For example, the base textile 44 may be formed from one or more yarns, fibers, threads, strands, cords, textiles, and the like, at least some of which have elastomeric properties that impart the stretch characteristic.

The elastic trim 42 shown in FIG. 4A includes a plurality of tunnel structures 46 that extend from a first end 48 of the elastic trim 42 to a second end 50 of the elastic trim 42 and along the length of the base textile 44. The elastic trim 42 is formed so that each tunnel structure 46 has a cable 64 movably positioned therein. The cables 64 extend from the first end 48 of the elastic trim 42 to the second end 50 of the elastic trim 42. Like the aspect depicted in FIG. 1, the base textile 44 is formed of materials having greater elastomeric properties than the cables 64, or in other words, the base textile 44 exhibits a higher stretch characteristic than the cables 64.

The cables 64 are exposed through openings 45 in the tunnel structures 46. The openings 45 may be formed in the base textile 44 during manufacturing of the elastic trim 42, or may be formed subsequent to the manufacturing of the elastic trim 42 in other contemplated aspects. The openings 45 permit the cables 64 in the tunnel structures 46 to move into and out of the tunnel structures 46 as the elastic trim 42 is stretched. In other words, because the base textile 44 exhibits higher stretch characteristics than the cables 64, the cables 64 may not change in length in the same way as the base textile 44 changes in length when the base textile 44 is stretched or de-stretched. Accordingly, the openings 45 in the tunnel structures 46 allow portions 65 of the cables 64 to enter/exit the tunnel structures 46 as needed during stretching and relaxing of the base textile 44.

FIG. 4A depicts how the woven elastic trim 42 includes three woven layers: a first layer 51, a second layer 53, and a third layer 55. Each of the woven layers 51, 53, 55 extends across the first, second, and third sections 52, 54, 56 of the elastic trim 42 from the first end 48 to the second end 50. The three layers 51, 53, 55 are interwoven with each other at the first section 52 and at the second section 54 of the elastic trim 42. This construction is shown, in accordance with one example aspect, in the cross-section depicted in FIG. 6A. The third section 56 includes only the first layer 51 and the second layer 53 interwoven with each other, while the third layer 55 remains separate from the first layer 51 and the second layer 53. In other words, the third layer 55 is not interwoven with the first layer 51 and the second layer 53 in the third section 56. This construction is shown, in accordance with one example aspect, in the cross-section depicted in FIG. 6B.

The tunnel structures 46 of the elastic trim 42 shown in FIG. 4A extend between the first layer 51 and the second layer 53, i.e., are formed/located at least partially between the first layer 51 and the second layer 53. The tunnel structures 46 do not extend through the third layer 55 at least with respect to the third section 56 of the elastic trim 42. In certain aspects, the third layer 55 may be formed from materials and/or with a construction that provides a stretch characteristic to the third layer 55. For example, the third layer 55 may be woven from one or more elastomeric yarns that impart a two-way stretch characteristic or a four-way stretch characteristic to the third layer 55. The third layer 55 may also have a first surface 58 that ultimately forms a wearer-facing portion or a wearer-contacting portion of the elastic trim 42 when the elastic trim 42 is integrated with an article (e.g., a waistband).

Similar to the aspect depicted in FIGS. 2A and 2B, the elastic trim 42 shown in FIG. 4A may initially be formed as part of a continuous length of elastic trim having multiple repeating sections, each of which corresponds, for the purposes of this example, to the length of elastic trim 42 shown in FIG. 4A. This repeating length of elastic trim may be manufactured with the cables 64 extending continuously through the tunnel structures 46 which extend through each of the repeating sections. This allows multiple elastic trims to be provided for separation and processing, after which the processed elastic trims can be incorporated into various articles in accordance with the aspects described herein.

The elastic trim 42 shown in FIG. 4A is presented in a pre-processed or partially processed form. In other words, the elastic trim 42 is shown prior to the processing steps described herein that impart variable stretch characteristics along a longitudinal length of the elastic trim 42. Instead, the cables 64 of the elastic trim 42 integrally extend through the tunnel structures 46 across the first section 52, the third section 56, and the second section 54, without having been secured and removed at particular locations. Example processing for achieving variable stretch characteristics across the longitudinal length of the elastic trim 42 are discussed below with respect to FIGS. 7A-7D.

Figure 4B:
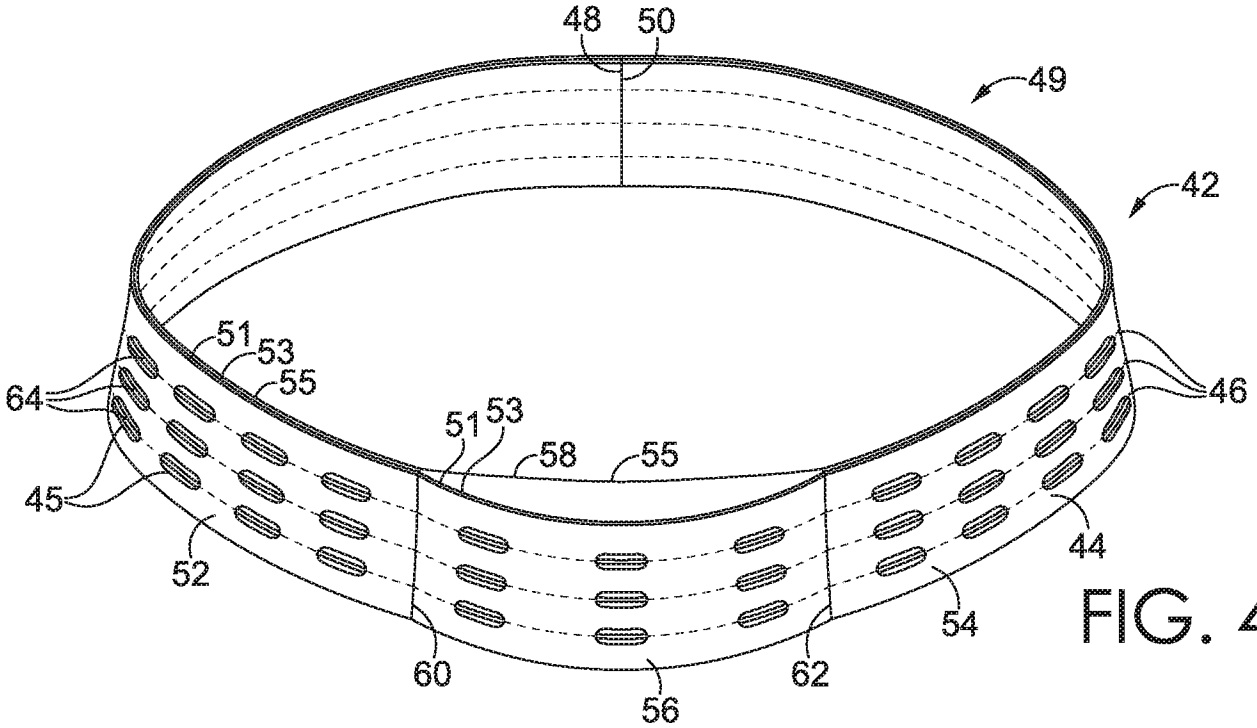
FIG. 4B depicts the woven elastic trim of FIG. 4A formed into a continuous circumference, in accordance with an aspect hereof.

Referring now to FIG. 4B, the length of elastic trim 42 of FIG. 4A is shown formed into a continuous circumference, in accordance with an aspect hereof. As shown in FIG. 4B, the first end 48 of the elastic trim 42 and the second end 50 of the elastic trim 42 have been brought together into contact and secured to each other so that the elastic trim 42 forms the continuous circumference 49. The first and second ends 48, 50 may be secured using any of the attachment methods discussed herein for example with respect to FIG. 3B (e.g., stitching, adhering, welding, use of an overlay, and the like). FIG. 4B depicts the elastic trim 42 at a processing step in which the third section 56 has not yet been modified to impart a variable stretch characteristic along the length of the elastic trim 42. In other words, FIG. 4B depicts the elastic trim 42 without the cables having been secured and removed from the tunnel structures 46 in the third section 56. However, it is contemplated that in an alternative aspect, this processing may occur before forming the elastic trim 42, or another aspect of an elastic trim, into a continuous circumference.

As shown in FIG. 4B, the third section 56 of the elastic trim 42 includes a first end 60 and a second end 62. The first and second ends 60, 62 represent locations at which the first layer 51 and the second layer 53 are no longer interwoven with the third woven layer 55, such that the third woven layer 55 extends separately across the third section 56 relative to the first and second layers 51, 53. FIG. 4B again depicts the elastic trim 42 without the processing that modifies the third section 56 to impart a modified stretch characteristic (e.g., by securing the cables 64 at the first and second ends 60, 62 and removing the cables 64 from the third section 56 so that they terminate at the first and second ends 60, 62). However, it should be noted that in other contemplated aspects, the processing of the third section 56 to impart the modified stretch characteristic may be performed before forming the elastic trim 42 into the circumferential shape. The order of such processing conferred by the aspects depicted in FIG. 4A and FIG. 4B is provided only as an example.

Figure 5:
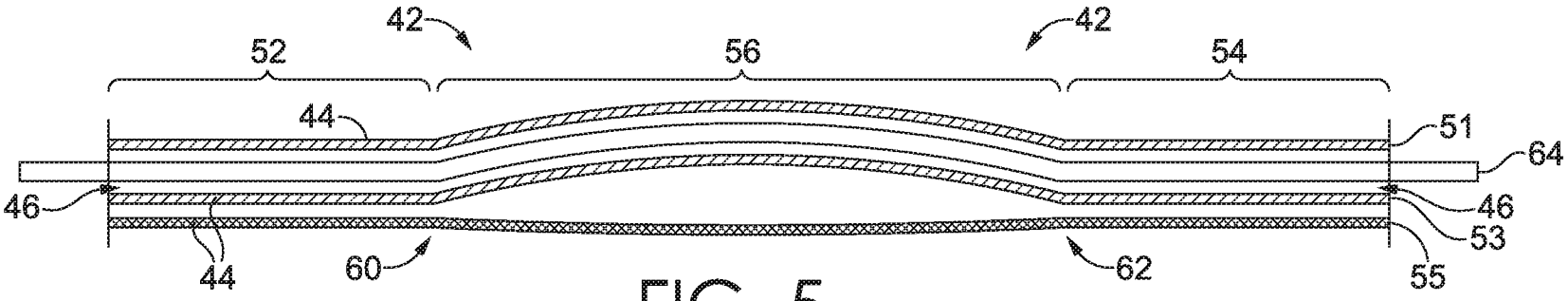
FIG. 5 depicts a simplified cross-section view of part of the woven elastic trim of FIGS. 4A and 4B, in accordance with an aspect hereof.

Referring now to FIG. 5, a cross-section view of the elastic trim 42 shown in FIG. 4A, taken along cut-line 5-5, is shown, in accordance with an aspect hereof. FIG. 5 depicts the three woven layers 51, 53, 55 of the elastic trim 42 in a simplified form for the purposes of explanation. In other words, it does not show the specific interweaving of the materials forming the woven layers 51, 53, 55, examples of which are depicted in FIGS. 6A and 6B, but rather FIG. 5 depicts the general arrangement of the woven layers 51, 53, 55 and the differences in construction between the third section 56 of the elastic trim 42 and the first section 52 and second section 54 of the elastic trim 42.

FIG. 5 depicts, generally, how the first, second, and third layers 51, 53, 55 are interwoven with each other in the first section 52 and in the second section 54 of the elastic trim 42, thereby forming a single, integral construction in these sections 52, 54. FIG. 5 also depicts how the tunnel structures 46 are formed between the first layer 51 and the second layer 53 of the elastic trim 42, and how the cable 64 is movably positioned within the tunnel structure 46 such that it extends through the tunnel structure 46 and across the longitudinal length of the elastic trim 42 (i.e., across at least a portion of the first section 52, the second section 54, and the third section 56 in the depicted aspect). The cables 64, as discussed herein, may be formed of a material and/or of a construction that exhibits lower elastomeric properties than the materials that form the base textile 44. This allows the cables 64 to impart a higher tension or stiffness, relatively speaking, in the elastic trim 42 than the base textile 44. The cables 64 may also have a larger diameter than the materials used to form the base textile 44. For example, the cables 64 may have a diameter that is larger than the diameter of one or more elastomeric yarns that form the base textile 44 of the elastic trim 42.

FIG. 5 further shows how the first end 60 and the second end 62 of the third section 56 represent locations at which the interweaving of the layers 51, 53, 55 changes. More specifically, as shown in FIG. 5, the first, second, and third layers 51, 53, 55 are interwoven with each other in the first section 52 and in the second section 54 (it should be noted that FIG. 5 is shortened proportionally for clarity purposes). Then, starting at the first end 60 and the second end 62, and moving into the third section 56, the first layer 51 and the second layer 53 remain interwoven with each other, while the third layer 55 is not interwoven with the first layer 51 and the second layer 53, such that the third layer 55 extends separately across the third section 56. This variation in the interweaving of the layers 51, 53, 55 allows the elastic trim 42 to be processed, for example as shown in FIGS. 7A-7D, to impart increased stretch characteristics to the third section 56 of the elastic trim 42. For example, the cables 64 located in the tunnel structures 46 can be removed by decoupling the interwoven first layer 51 and second layer 53 from the third section 56, while leaving the third layer 55 extending across the third section 56 to provide a stretch characteristic to the third section 56. One example of such processing is shown in FIGS. 7A-7D.

Figure 6A:
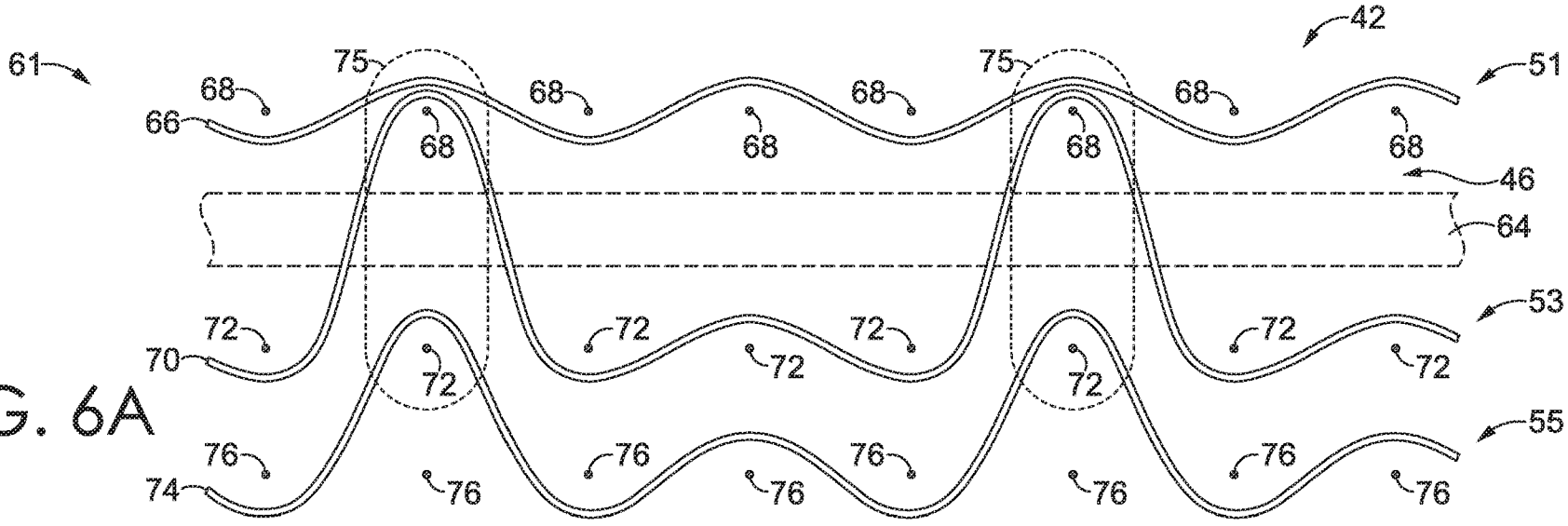
FIG. 6A depicts a cross-section view of part of the elastic trim shown in FIGS. 4A and 4B, taken along a longitudinal length of a set of warp yarns used to form the elastic trim, in accordance with an aspect hereof.
Figure 6B:
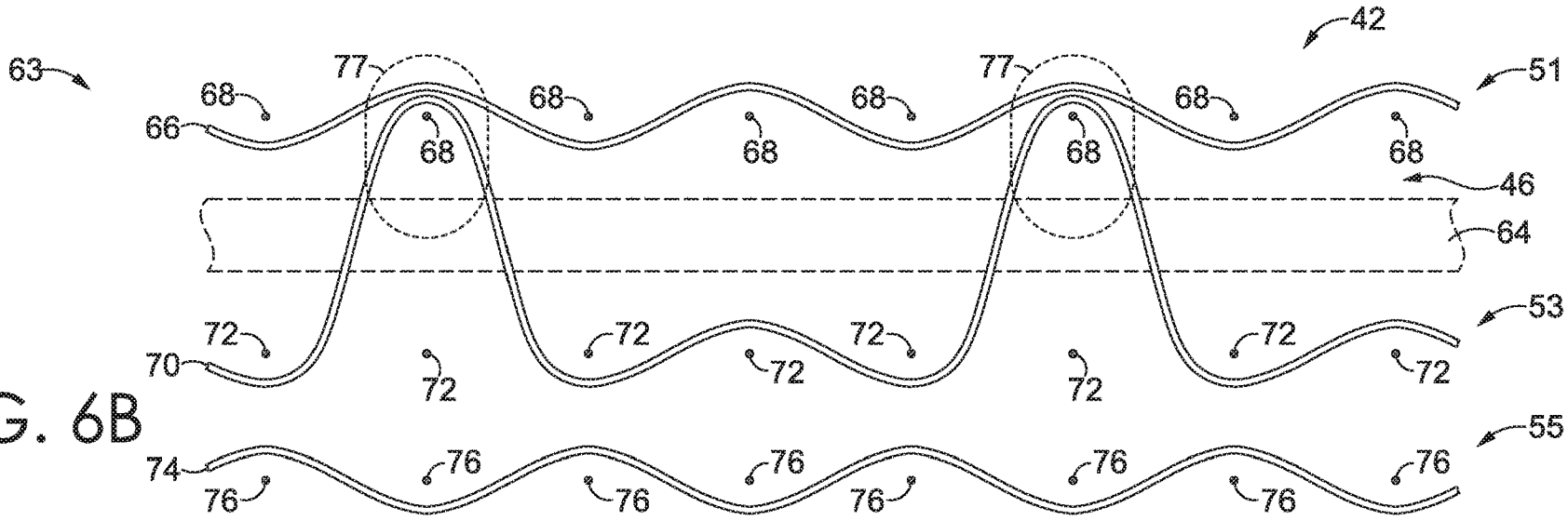
FIG. 6B depicts a cross-section view of another part of the elastic trim shown in FIGS. 4A and 4B, in accordance with an aspect hereof.

Referring now to FIG. 6A, a cross-section view of a first longitudinal portion 61 of the elastic trim 42, taken along a longitudinal length of a set of warp yarns, is provided, in accordance with an aspect hereof. FIG. 6A depicts the interweaving of the first layer 51, the second layer 53, and the third layer 55 in the first longitudinal portion 61, which may represent either a longitudinal portion of the first section 52 or the second section 54 of the elastic trim 42. FIG. 6A also illustrates how the cable 64 is movably positioned in the tunnel structure 46 formed at least partially between the first layer 51 and the second layer 53 of the elastic trim 42. In this depicted aspect, the first layer 51, the second layer 53, and the third layer 55 are each formed from a plurality of warp yarns interwoven with a plurality of weft yarns (shown in cross-section) at select locations.

FIG. 6A shows how the first layer 51 of the elastic trim 42 includes at least a first warp yarn 66 that is interwoven with a first set of weft yarns 68, thereby forming the woven first layer 51. The first warp yarn 66 and/or the first set of weft yarns 68 form part of the base textile 44 shown in FIG. 4A, and may have elastomeric properties. FIG. 6A also shows how the second layer 53 of the elastic trim 42 includes a second warp yarn 70 that is interwoven with a second set of weft yarns 72 and also with a portion of the first set of weft yarns 68 in the first layer 51, thereby forming the woven second layer 53 while also interweaving the second layer 53 with the first layer 51.

FIG. 6A further shows how the third layer 55 of the elastic trim 42 includes a third warp yarn 74 that is interwoven with a third set of weft yarns 76 and also with a portion of the second set of weft yarns 72, thereby forming the woven third layer 55 while also interweaving the third layer 55 with the second layer 53. Accordingly, as shown by the cross-section of FIG. 6A representing part of either the first section 52 or the second section 54, the first layer 51, the second layer 53, and the third layer 55 are formed such that they are interwoven at one or more areas 75.

FIG. 6A depicts one particular weaving configuration of the warp yarns 66, 70, 74 and the weft yarns 68, 72, 76. This configuration includes interweaving at particular locations and/or in particular repeating patterns. However, it is contemplated that numerous other weaving configurations and patterns may be utilized with the aspects described herein. For example, the third warp yarn 74 may also be interwoven with the first set of weft yarns 68 to thereby interweave the first, second, and third layers 51, 53, 55 of the elastic trim 42. The yarns may also be interwoven at different intervals. For example, the warp yarns 66, 70, and/or 74 may be interwoven with the weft yarns 68, 72, and/or 76 at different intervals to provide a one-over-one, two-over-two, one-over-two, two-over-one, and the like, type of weaving pattern in contemplated aspects. In other words, any weaving configuration that provides the depicted integration/separation of the layers 51, 53, 55 shown in FIGS. 4A and 4B and FIG. 5B is contemplated with regard to the aspects described herein.

Referring now to FIG. 6B, a cross-section view of another longitudinal portion 63 of the elastic trim 42 is shown, in accordance with an aspect hereof. The longitudinal portion 63 represents part of the third section 56 of the elastic trim 42. FIG. 6B again illustrates how the cable 64 is movably positioned in the tunnel structure 46 formed within the first and second layers 51, 53 of the elastic trim 42. FIG. 6B also shows how the first layer 51 of the elastic trim 42 includes the first warp yarn 66 that is interwoven with the first set of weft yarns 68. FIG. 6B also shows the second layer 53 of the elastic trim 42 with the second warp yarn 70 interwoven with the second set of weft yarns 72 and also with a portion of the first set of weft yarns 68 of the first layer 51, thereby forming the woven second layer 53 while also interweaving the second layer 53 with the first layer 51 at one or more areas 77. FIG. 6B further shows the third layer 55 of the elastic trim 42 in which the third warp yarn 74 is interwoven with the third set of weft yarns 76. However, in contrast to the configuration of the first longitudinal portion 61 shown in FIG. 6A, the longitudinal portion 63 shown in FIG. 6B does not have the third warp yarn 74 interwoven with either the first set of weft yarns 68 or the second set of weft yarns 72. As a result, the third layer 55 remains separate from the first layer 51 and the second layer 53 in the third section 56 of the elastic trim 42.

FIG. 6B depicts one particular weaving configuration forming a particular construction of warp yarns and weft yarns at particular locations and/or in particular repeating patterns as it pertains to the third section 56 of the elastic trim 42 shown in FIGS. 4A-4B. However, other configurations and patterns are contemplated herein. For example, the warp yarns and the weft yarns may be interwoven at different intervals and/or in different locations. For example, the warp yarns 66, 70 may be interwoven with the weft yarns 68, 72 at different intervals to provide a one-over-one, two-over-two, one-over-two, two-over-one, and the like, type of weaving pattern in the base textile 44 of the elastic trim 42. Any weaving pattern that provides the depicted integration/separation of layers 51, 53, 55 in the elastic trim shown in FIGS. 4A and 4B is contemplated herein.

Referring now to FIGS. 7A-7D, a series of cross-section views of the elastic trim 42 during a process of imparting variable stretch characteristics therein is provided, in accordance with aspects hereof. Once again, for the purposes of simplicity, clarity, and explanation, the exact interweaving of the layers 51, 53, 55 of the elastic trim 42 is not shown in full detail in FIGS. 7A-7D. However, in actual implementation, the elastic trim 42 may be formed of yarns interwoven with each other at various locations to form an interwoven construction, such as, for example, as shown in FIGS. 6A and 6B. It should further be noted that the first, second, and third sections 52, 54, 56 are not depicted to reflect proportional lengths as shown in comparison to FIGS. 4A and 4B. This is only for the purposes of clarity and explanation with respect to FIGS. 7A-7D.

Figure 7A:
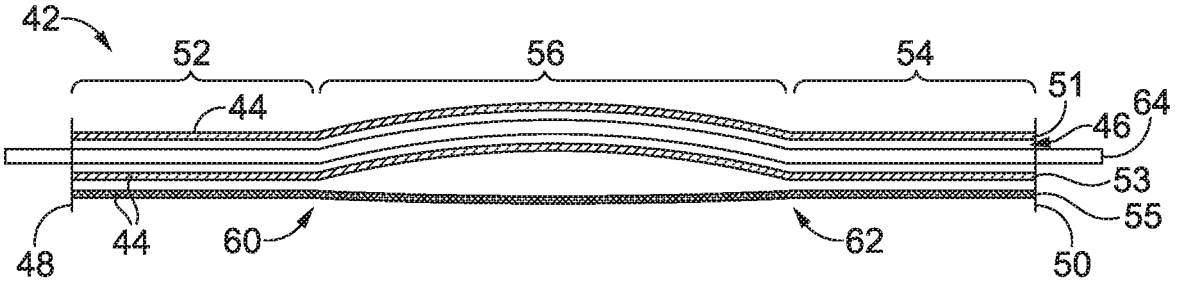
FIGS. 7A-7D depict a series of cross-section views showing the elastic trim of FIG. 4A or FIG. 4B being processed, in accordance with aspects hereof.
Figure 7B:
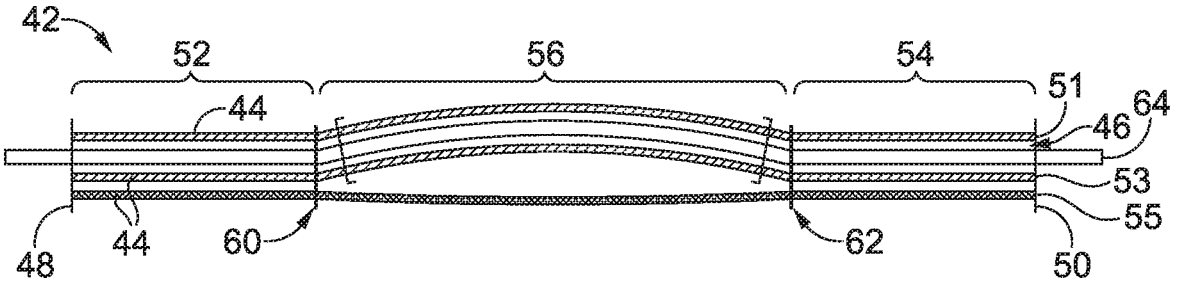

FIG. 7A depicts the elastic trim 42 of FIGS. 4A and 4B prior to being processed to impart variable stretch characteristics along its length. FIG. 7B depicts a point at which the cable 64, the first layer 51, the second layer 53, and the third layer 55 are secured at the first end 60 of the third section 56 and at the second end 62 of the third section 56. This securement of the first end 60 and the second end 62 may be provided in various aspects through stitching, tacking, adhering, welding, and the like. This securement may restrict or prevent movement of the cable 64 and the layers 51, 53, 55, at least partially, at the first end 60 and at the second end 62.

Figure 7C:
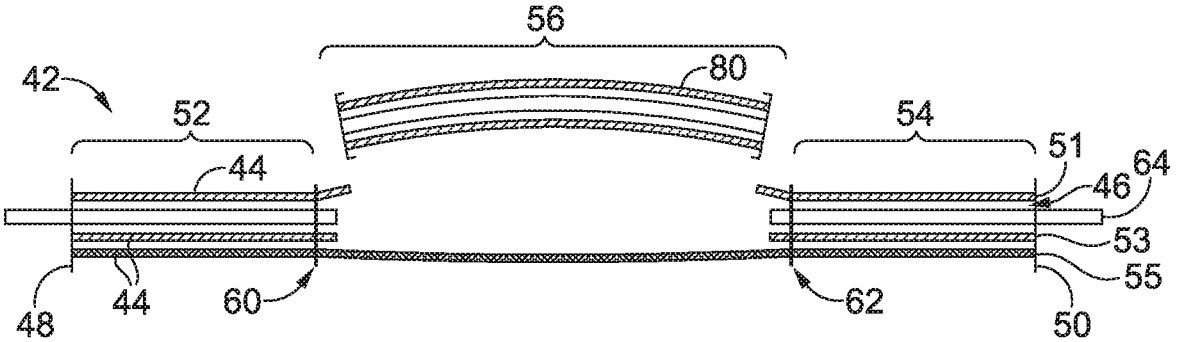

FIG. 7C depicts the elastic trim 42 with a portion 80 of the third section 56 removed (e.g., cut out). In particular, part of the first layer 51, part of the second layer 53, and a part of the cable 64 have been removed from the elastic trim 42 such that only the third layer 55 extends between, i.e., is interposed between, the first end 60 and the second end 62 of the third section 56. As discussed herein, the third layer 55 may be formed from one or more materials that exhibit a stretch characteristic (e.g., one or more elastomeric yarns), and as a result, after the portion 80 is removed, the third section 56 may exhibit a higher stretch characteristic than the first section 52 and the second section 54. The first section 52 and the second section 54 still include the cables 64 secured at the first end 48 and the second end 50 of the elastic trim 42 and at the first end 60 and the second end 62 of the third section 56. The stretch characteristic provided by the third layer 55 may be a two-way stretch characteristic or a four-way stretch characteristic in different contemplated aspects.

Figure 7D:
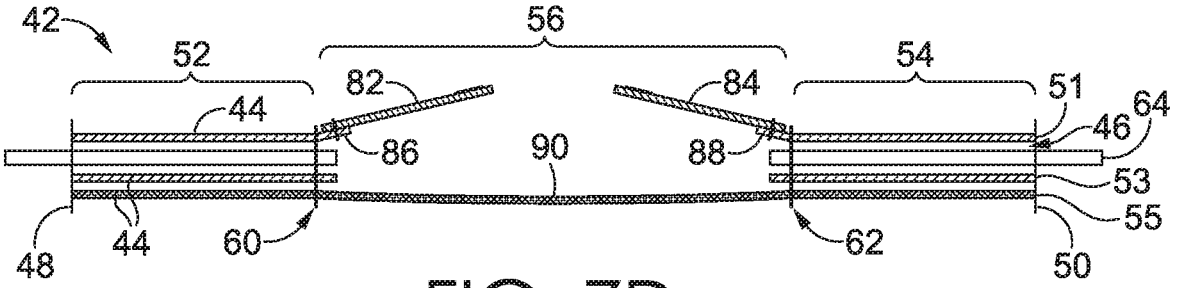
Figure 8B:
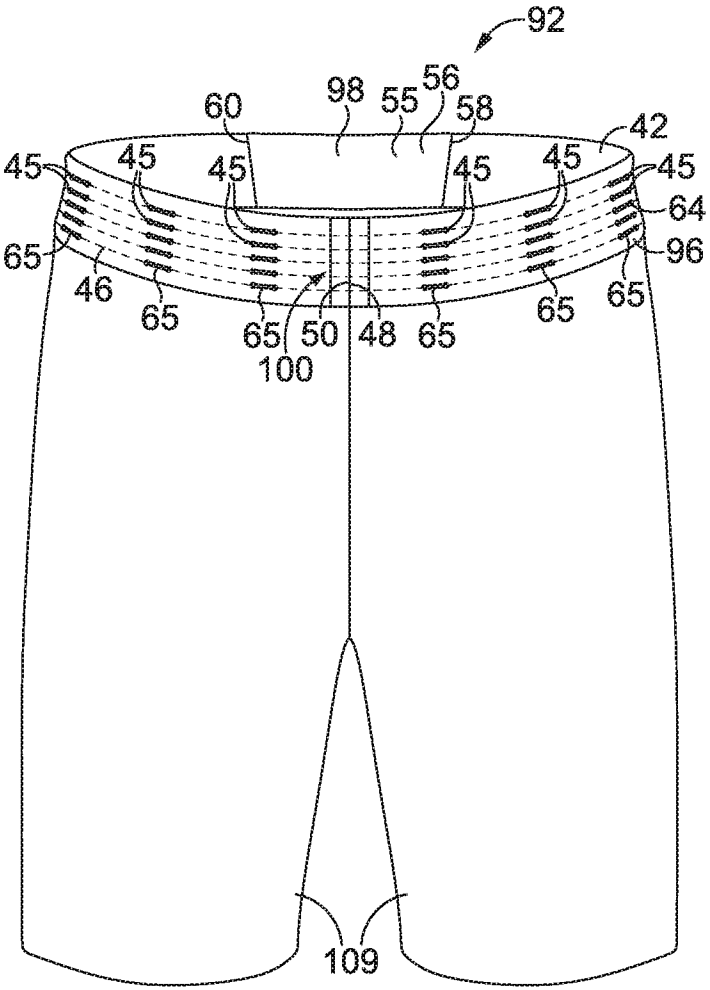
FIG. 8B depicts a rear portion of the article of apparel shown in FIG. 8A, in accordance with an aspect hereof.
Figure 8A:
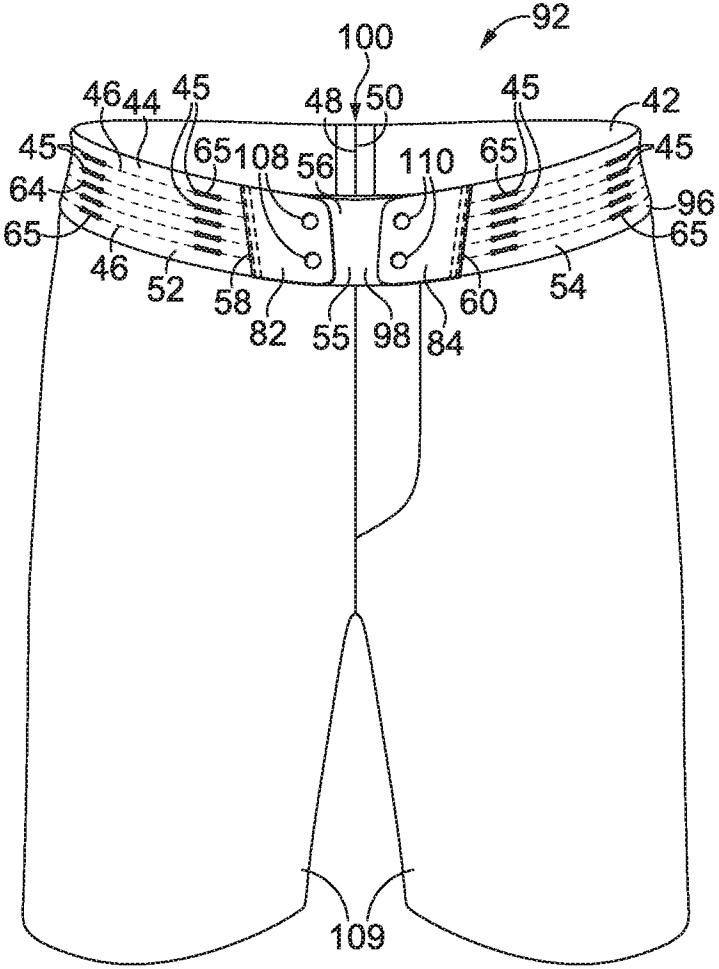
FIG. 8A depicts a front portion of an article of apparel with a waistband formed at least in part from the elastic trim of FIGS. 4A and 4B, in accordance with an aspect hereof.

FIG. 7D depicts the elastic trim 42 after the portion 80 of the third section 56 has been removed, and subsequently, a first tab 82 and a second tab 84 have been coupled to the elastic trim 42. In particular, the first tab 82 is secured to the first end 60 of the third section 56 proximate a first distal end 86 of the first layer 51, and the second tab 84 is secured to the second end 62 of the third section 56 proximate a second distal end 88 of the first layer 51. The tabs 82, 84 may be coupled through stitching, adhering, welding, and the like in contemplated aspects. The tabs 82, 84 may also be formed from different materials and constructions. For example, the tabs 82, 84, an example configuration of which is shown in FIGS. 8A and 8B, may include elastomeric materials (e.g., elastomeric yarns, fibers, threads, cords, textiles, and the like), and/or may include non-elastomeric materials (e.g., non-elastomeric yarns, fibers, threads, cords, textiles, polymers, and the like). Further, the tabs 82, 84 may each include at least one aperture, as shown for example in FIGS. 8A and 8B. These apertures allow a lanyard to be threaded and used for imparting tension to the elastic trim 42. For example, by pulling on a lanyard threaded through the apertures in the tabs 82, 84, a tension may be imparted to the cables 64 to cinch the elastic trim 42 around a portion of a wearer. In additional contemplated aspects, a lanyard may be coupled to the elastic trim 42 to help retain the lanyard against the elastic trim 42. For example, a lanyard may be affixed (e.g., stitched, adhered, welded, and the like), in one contemplated aspect, to the third layer 55 proximate a location 90 as shown in FIG. 7D.

Referring to FIGS. 8A and 8B, the elastic trim 42 described in previous sections is shown forming a waistband 96 of an article of apparel 92, in accordance with an aspect hereof. FIGS. 8A-8B depict the article of apparel 92 as a lower body article of apparel, which, for example purposes, is depicted as a pair of water shorts. However, it is contemplated that the elastic trims described herein, e.g., the elastic trim 42, may be incorporated into other lower body articles of apparel, such as pants, tights, ¾ lengths, capris, and the like. Accordingly, the water shorts depicted in FIGS. 8A-8B are provided only as one non-limiting example use of an elastic trim in a lower body article of apparel. The article of apparel 92 shown in FIGS. 8A-8B includes a pair of leg portions 109 coupled to the waistband 96. The waistband 96 and leg portions 109 may be coupled by stitching, adhering, welding, or another attachment process in contemplated aspects.

FIG. 8A depicts how the article of apparel 92, and in particular, the waistband 96, includes a front portion 98 that forms a cinching or tensioning portion of the waistband 96. In this respect, the elastic trim 42 shown in FIGS. 4A and 4B has been modified as shown in FIGS. 7A-7D and incorporated into the article of apparel 92 so that the modified third section 56 shown in FIG. 7D is located at the front portion 98. This allows the third layer 55 extending across the third section 56 to form a stretch-based front area of the waistband 96 that may provide comfort and adjustability for a wearer. The tabs 82, 84 are shown coupled to the front portion 98 with respective apertures 108, 110 formed therein that can be used for threading a lanyard. The lanyard can then be pulled to impart tension to the waistband 96. The elastic trim 42, and by association the waistband 96, includes the openings 45 in the tunnel structures 46 that allow portions 65 of the cables 64 to move into and out of the openings 45 in the tunnel structures 46 when the elastic trim 42 is tensioned. In this respect, the tensioning of the elastic trim 42 and by association the waistband 96 causes the base textile 44, which exhibits greater stretch characteristics than the cables 64, to change in length more so than the cables 64, and thus the openings 45 accommodate the excess length of cables 64 that may be present during such tensioning.

FIG. 8B depicts a rear portion 100 of the article of apparel 92 and the waistband 96 formed from the elastic trim 42 as modified in FIGS. 7A-7D. FIG. 8B shows how the first end 48 of the elastic trim 42 and the second end 50 of the elastic trim 42 are coupled together and secured to form the continuous circumference 49 shown in FIG. 4B that is incorporated into/as the waistband 96. The first end 48 and the second end 50 of the elastic trim 42 may be secured at the rear portion 100 using any attachment method contemplated herein, such as stitching, adhering, welding, using an overlay, and the like. It should be noted that additional processing steps that may be necessary to fully incorporate the modified elastic trim 42 into the waistband 96 of the article of apparel 92 may be performed. For example, additional stitching, taping, adhering, dying, application of overlays and layers, and/or application of surface treatments, in addition to affixing the modified elastic trim 42 to the leg portions 109, is possible and contemplated herein with respect to the depicted aspect.

Figure 9:
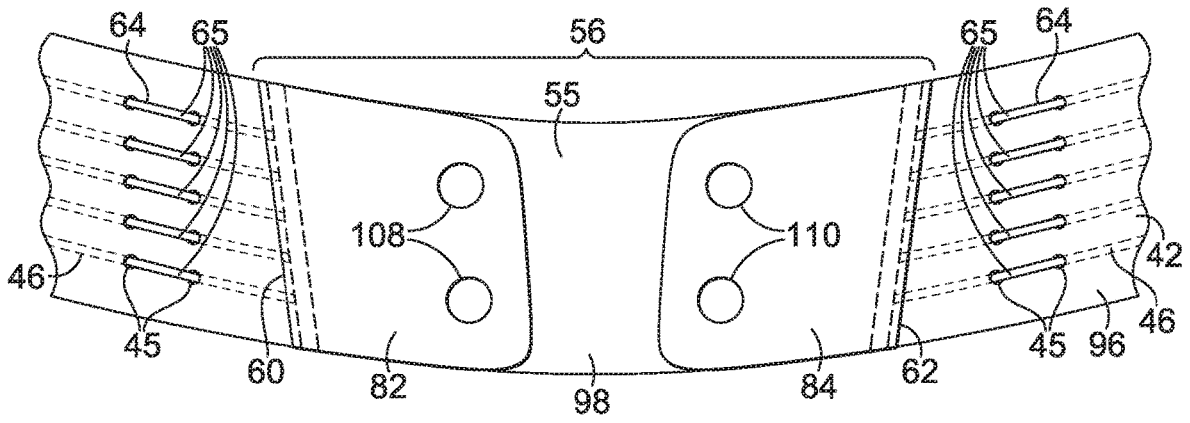
FIG. 9 depicts a partial, enlarged view of the front portion of the article of apparel shown in FIG. 8A, in accordance with an aspect hereof.

Referring now to FIG. 9, a partial, enlarged view of the front portion 98 of the waistband 96 forming part of the article of apparel 92 shown in FIGS. 8A-8B is provided, in accordance with an aspect hereof. FIG. 9 depicts the tabs 82, 84 of the waistband 96 that each include respective apertures 108, 110. The tabs 82, 84 are coupled respectively to the first and second ends 60, 62 of the third section 56 of the elastic trim 42. This coupling of the tabs 82, 84 secures the cables 64 at these locations on the waistband 96. FIG. 9 further depicts the openings 45 that expose portions 65 of the cables 64 movably positioned in the tunnel structures 46. These openings 45, as discussed herein, allow the cables 64 to move into and out of the tunnel structures 46 during tensioning of the waistband 96. FIG. 9 further depicts how in the front portion 98, the third woven layer 55 of the modified elastic trim 42 extends between the first end 60 and the second end 62 of the third section 56 of the modified elastic trim 42, without the first layer 51, the second layer 53, or the cable 64 included. The front portion 98 of the waistband 96 thus exhibits a greater stretch characteristics in at least the longitudinal direction due to the absence of the cables 64 in this section.

Figure 10:
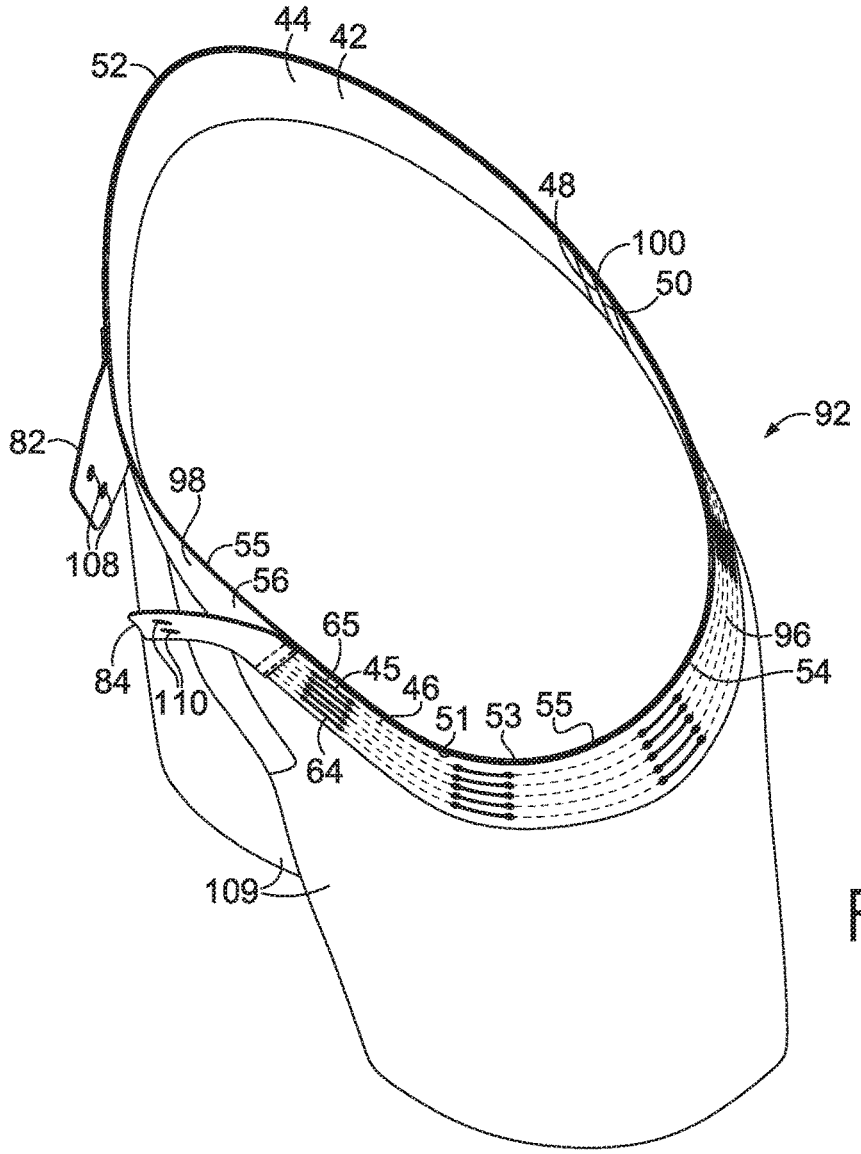
FIG. 10 depicts an angled, perspective view of the article of apparel shown in FIGS. 8A-8B, in accordance with an aspect hereof.

Referring now to FIG. 10, a top-down, perspective view of the article of apparel 92 shown in FIGS. 8A-8B is provided, in accordance with an aspect hereof. FIG. 10, in particular, depicts the construction of the waistband 96, which as discussed is formed from the modified elastic trim 42. FIG. 10 shows how the first end 48 of the elastic trim 42 and the second end 50 of the elastic trim 42 are coupled together and secured at a rear portion 100 of the waistband 96 that is circumferentially spaced from the front portion 98 of the waistband 96. FIG. 10 further shows how the first section 52 and the second section 54 of the elastic trim 42 include the woven first, second, and third layers 51, 53, 55, and from the process depicted in FIGS. 7A-7D, the front portion 98 of the waistband 96 includes only the third layer 55, without the first layer 51, the second layer 53, or the cables 64. The increased stretch characteristic imparted to the front portion 98 by the third layer 55 may provide increased comfort, ease of adjustability, e.g., during donning, doffing, and tightening of the article of apparel 92, and better movability and adjustability for the wearer, in addition to other benefits.

Figure 11:
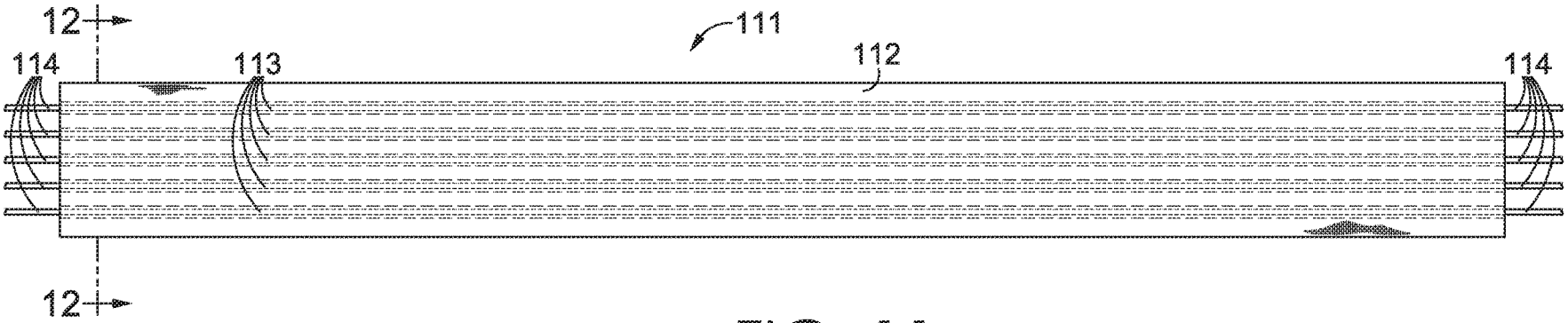
FIG. 11 depicts an elevation view of a knitted elastic trim, in accordance with an aspect hereof.
Figure 12:
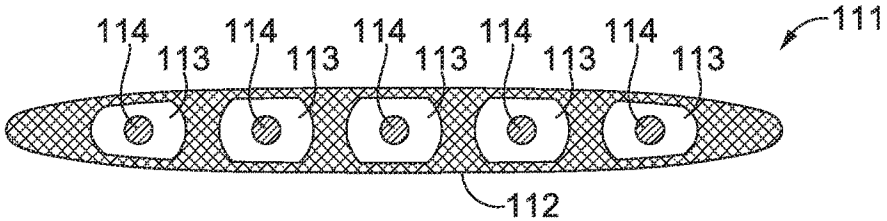
FIG. 12 depicts a cross-section view of the knitted elastic trim shown in FIG. 11, in accordance with an aspect hereof.

Referring to FIG. 11, a length of elastic trim 111 formed from a knitted construction is provided, in accordance with an aspect hereof. The elastic trim 111 depicted in FIG. 11 is formed by knitting one or more materials together to form a base textile 112 having a plurality of tunnel structures 113. Each tunnel structure 113 includes a respective cable 114 movably positioned therein. The materials knitted to form the base textile 112 may include one or more yarns, fibers, threads, cords, strands, and the like which may also exhibit elastomeric properties to impart a stretch characteristic to the base textile 112. The cables 114 may be formed of any material or construction that provides lower elastomeric properties than the materials used to form the base textile 112. For example, the cables 114 may be formed to be non-stretch or substantially non-stretch in contemplated aspects. In other words, the base textile 112 exhibits a greater stretch characteristic than the cables 114 positioned in the tunnel structures 113. The elastic trim 111 shown in FIG. 11 is presented as a length that may be cut into multiple sections to allow those sections to be individually processed, e.g., for incorporation into an article of apparel. Referring to FIG. 12, a cross-section view of the elastic trim 111 shown in FIG. 11, taken along cut-line 12-12, is provided, in accordance with an aspect hereof. FIG. 12 shows how the base textile 112 is integrally knitted such that it forms a plurality of tunnel structures 113. Each of the tunnel structures 113 includes a cable 114 movably positioned therein.

Figure 13A:
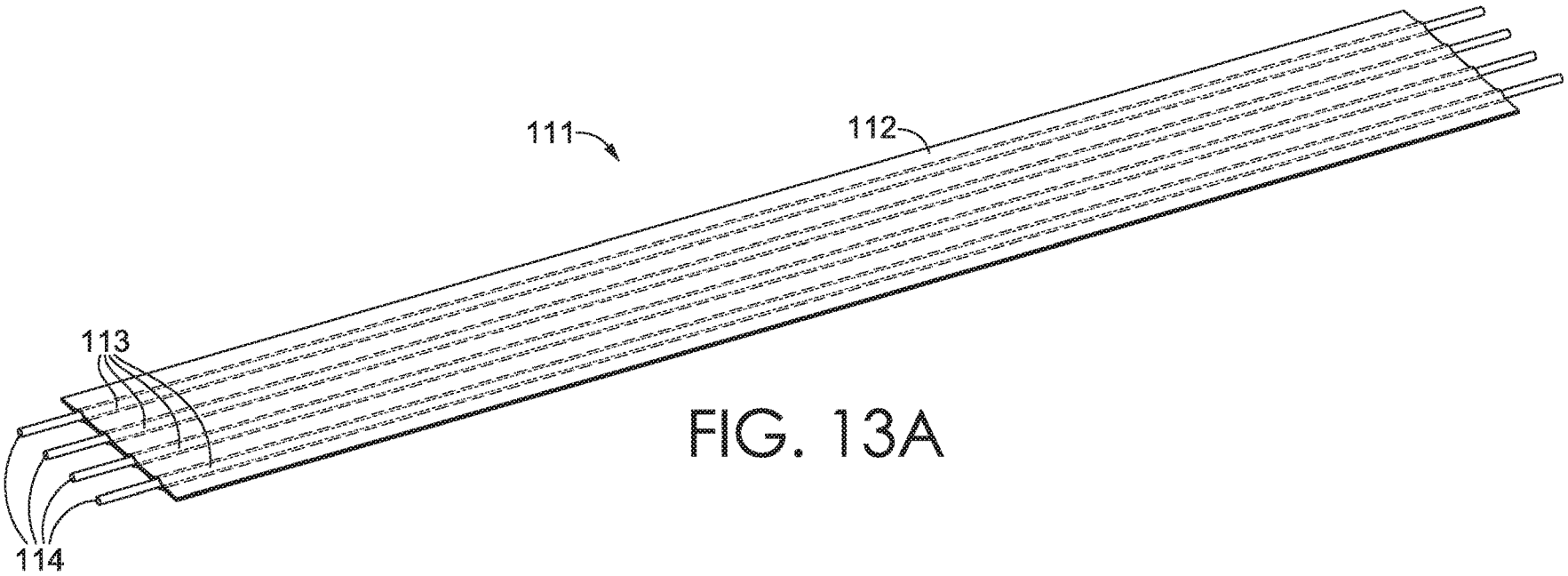
FIGS. 13A-13D depict a series of perspective views of the knitted elastic trim of FIG. 11 being processed, in accordance with an aspect hereof.
Figure 13B:
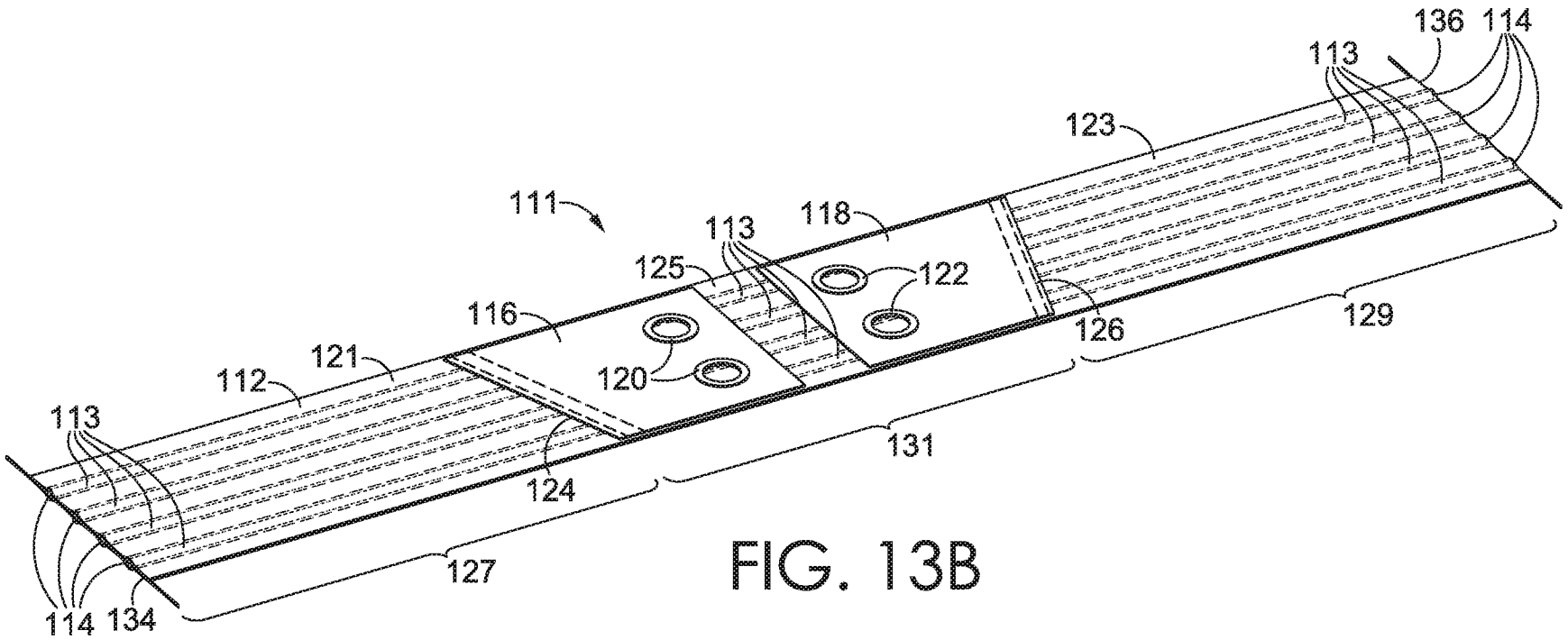

Referring to FIGS. 13A-13D, an example process for modifying the knitted elastic trim 111 shown in FIGS. 11 and 12 to impart variable stretch characteristics along the longitudinal length of the knitted elastic trim 111 is provided, in accordance with an aspect hereof. FIG. 13A shows the knitted elastic trim 111 of FIGS. 11 and 12 prior to the processing that imparts the variable stretch therein. FIG. 13B shows a processing step in which a pair of tabs 116, 118 are coupled to the elastic trim 111 at first and second locations 124, 126 on the elastic trim 111. This coupling of the tabs 116, 118 to the knitted elastic trim 111 secures the cables 114 at those locations, and segments the length of the knitted elastic trim 111 into a first section 121 having a first longitudinal length 127, a second section 123 having a second longitudinal length 129, and a third section 125 having a third longitudinal length 131. The third section 125 represents an interposed portion extending between the first location 124 and the second location 126, where increased stretch characteristics are to be imparted to the knitted elastic trim 111 through the processing described herein.

Figure 13C:
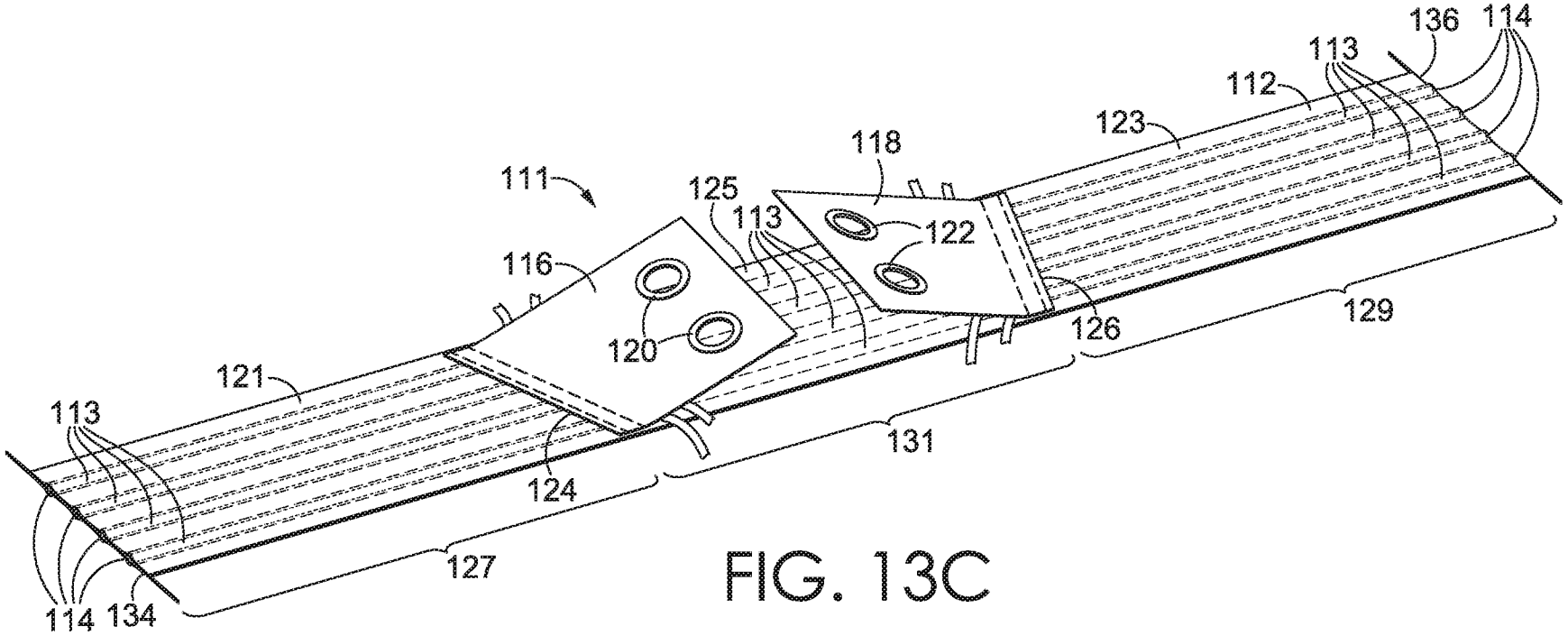

The tabs 116, 118 shown in FIGS. 13B and 13C each have a pair of apertures 120, 122 formed therein. It should be noted that the apertures 120, 122 may be formed in the tabs 116, 118 at any step in the processing (e.g., before or after attachment of the tabs 116, 118 to the elastic trim 111). Further, while a pair of apertures 120, 122 are depicted in each tab 116, 118, any number of apertures may be utilized in such tabs. The apertures 120, 122 may be sized and positioned so that a lanyard can be threaded through the apertures 120, 122 and used to impart tension to the elastic trim 111, e.g., when the elastic trim 111 is incorporated into an article of apparel.

Figure 13D:
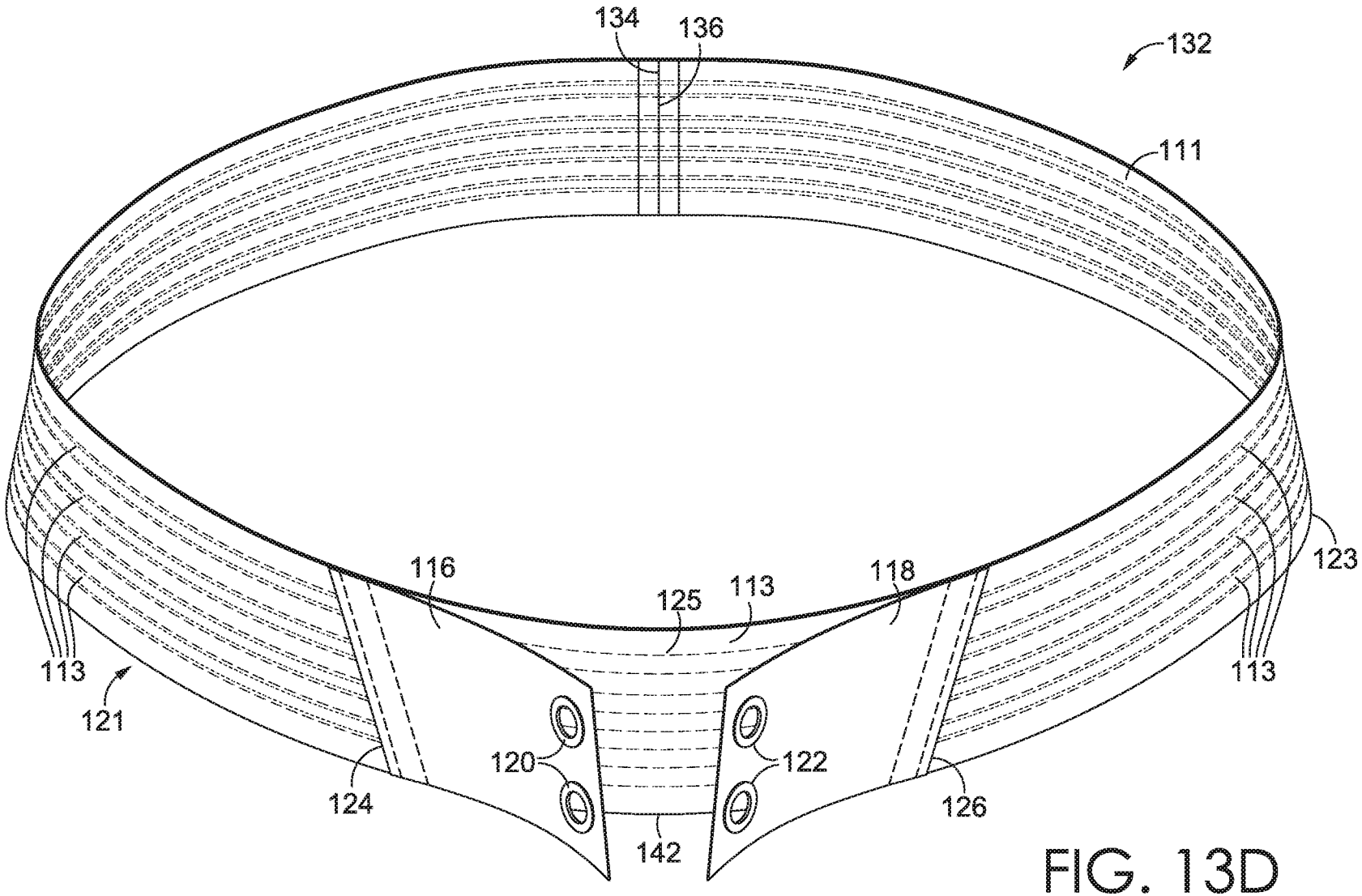

FIG. 13C depicts how the third section 125 of the elastic trim 111 is processed to impart to it an increased stretch characteristic. The tabs 116, 118 coupled to the base textile 112 secure the cables 114 at the first location 124 and at the second location 126. The cables 114 in the third section 125 are then exposed (e.g., pulled out from the tunnel structures 113) and then removed (e.g., cut out). These lengths of the cables 114 may be removed using existing apertures in the tunnel structures 113 or using apertures formed for the purpose of removing the cables 114. The extracted and cut cables are shown in FIG. 13D. From this processing, the base textile 112 may remain extending between the first location 124 and the second location 126 in the third section 125, without the cables 114 movably positioned in the tunnel structures 113 of the third section 125. This imparts to the third section 125 a higher stretch characteristic compared to the first section 121 and the second section 123 in which the cables 114 are still present. Depending on the construction of the knitted elastic trim 111, the imparted stretch may be a two-way stretch or a four-way stretch.

FIG. 13D depicts the knitted elastic trim 111, modified as shown in FIG. 13C, formed into a continuous circumference 132. The continuous circumference 132 has been formed by bringing a first end 134 of the knitted elastic trim 111 as modified in FIG. 13C into contact with a second end 136 of the knitted elastic trim 111 as modified in FIG. 13C and securing the first and second ends 134, 136 together using one of the attachment processes described herein (e.g., stitching, adhering, welding, folding, using an overlay, and the like).

From the processing shown in FIGS. 13A-13C, the continuous circumference 132 exhibits variable stretch characteristics along its longitudinal length. In particular, the first section 121 of the knitted elastic trim 111 and the second section 123 of the knitted elastic trim 111 exhibit a similar stretch characteristic due to the presence of the cables 114 in the tunnel structures 113 and their securement at the ends 134, 136 and the locations 124, 126. The third section 125 extends between the first location 124 on the modified elastic trim 111 and the second location 126 on the modified elastic trim 111 and exhibits a higher stretch characteristic than the first section 121 and the second section 123 due to the absence of the cables 114 from the third section 125. The third section 125 thus represents an interposed portion 142 extending between the first location 124 and the second location 126 on the modified elastic trim 111.

As discussed previously, the cables 114 are formed from materials and/or a construction that exhibits lower elastomeric properties than the base textile 112 of the knitted elastic trim 111. The continuous circumference 132 shown in FIG. 13D, like any of the other elastic trims described herein that are formed into a continuous circumference, may undergo additional processing and/or may subsequently be incorporated into some type of article (e.g., a waistband, an article of apparel, an article footwear, a bag, and the like) to impart a component that exhibits variable stretch and/or allows tensioning with increased versatility, as shown for example with respect to the article of apparel 144 shown in FIGS. 14A and 14B.

Figure 14B:
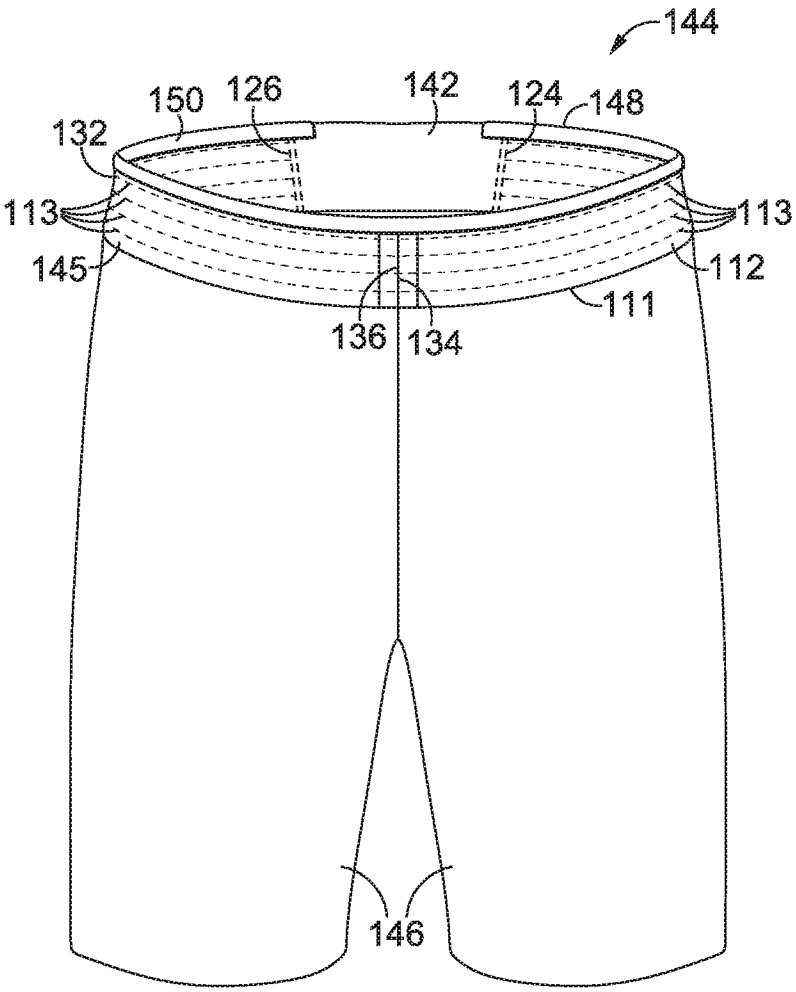
FIG. 14B depicts a rear portion of the article of apparel of FIG. 14A, in accordance with an aspect hereof.
Figure 14A:
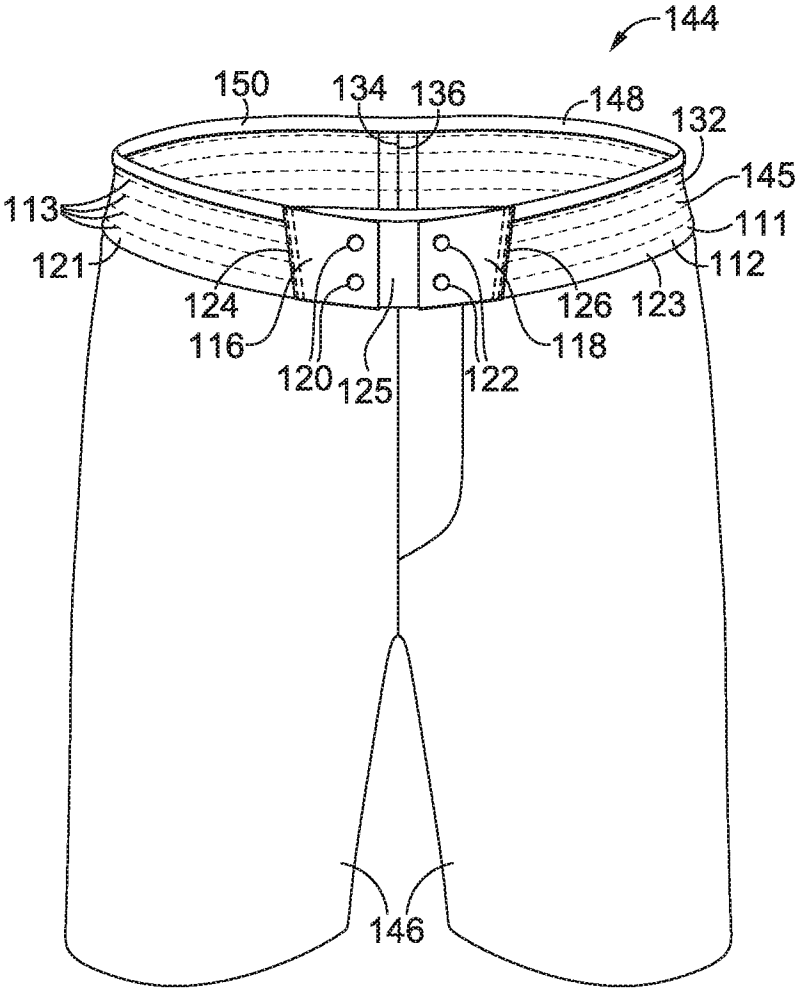
FIG. 14A depicts a front portion of an article of apparel incorporating the knitted elastic trim processed as shown in FIGS. 13A-13D, in accordance with an aspect hereof.

FIGS. 14A and 14B depict an article of apparel 144 that includes the elastic trim 111 modified as shown in FIGS. 13A-13D and incorporated into the article of apparel 144 as a waistband 145, in accordance with an aspect hereof. FIG. 14A depicts the front portion of the article of apparel 144 and FIG. 14B depicts the rear portion of the article of apparel 144. The article of apparel 144 shown in FIGS. 14A-14B is a lower body article of apparel, and in particular, is depicted as a pair of water shorts. Although a pair of water shorts is shown, it should be noted that the modified elastic trim 111 may be incorporated into other lower body articles in different contemplated aspects, such as pants, tights, % lengths, capris, and the like. In addition, as with each of the other elastic trims described herein, the modified elastic trim 111 may also be incorporated into other types of articles (e.g., an upper body article of apparel, an article of footwear, a bag, and the like) to impart a structure with variable stretch characteristics.

The article of apparel 144 shown in FIGS. 14A and 14B includes a pair of leg portions 146. The article of apparel 144 also includes an upper margin 148. The upper margin 148 corresponds to an edge of the waistband 145 formed by the knitted elastic trim 111 modified as shown in FIGS. 13A-13D. The upper margin 148 of the article of apparel 144 also includes a folded and/or overlaid structure 150 that provides a contoured or smoothed transition over the upper margin 148. This folded and/or overlaid structure 150 may increase the comfort and durability of the waistband 145. The folded and/or overlaid structure 150 may be a textile that is overlaid and secured, e.g., stitched, adhered, welded, and the like, to the base textile 112.

Figure 15:
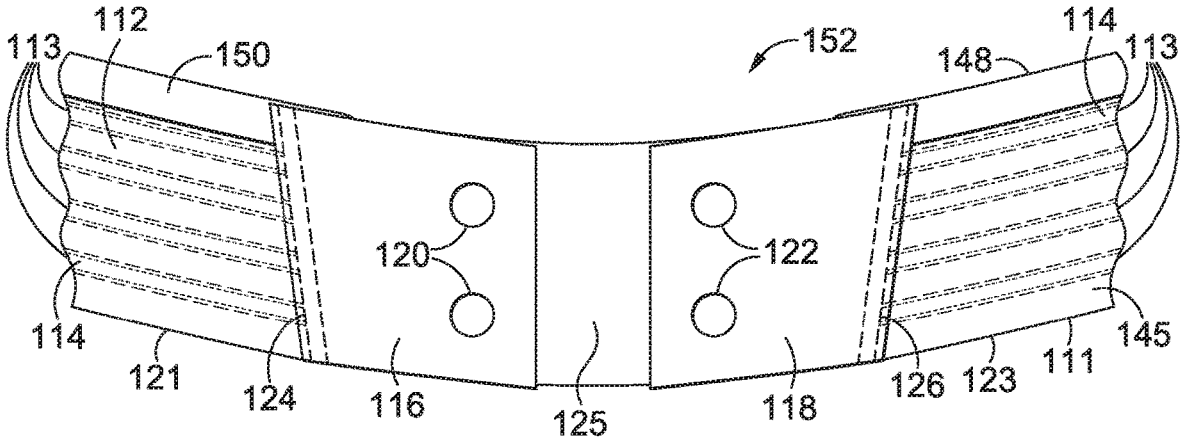
FIG. 15 depicts a partial, enlarged view of the front portion of the article of apparel shown in FIGS. 14A-14B, in accordance with an aspect hereof.

Referring now to FIG. 15, a partial, enlarged view of a front portion 152 of the waistband 145 of the article of apparel 144 shown in FIGS. 14A-14B is provided, in accordance with an aspect hereof. The front portion 152 shown in FIG. 15 depicts the tabs 116, 118, each of which includes the corresponding pair of apertures 120, 122 through which a lanyard may be threaded for use in cinching and/or tensioning the waistband 145. The tabs 116, 118 are coupled, respectively, at the first and second locations 124, 126. The third section 125 that provides increased stretch is positioned at the front portion 152 of the waistband 145. The cables 114 are otherwise present in the tunnel structures 113 of the first section 121 and the second section 123 of the elastic trim 111 as modified in FIGS. 13A-13D and formed into the waistband 145.

Figure 16:
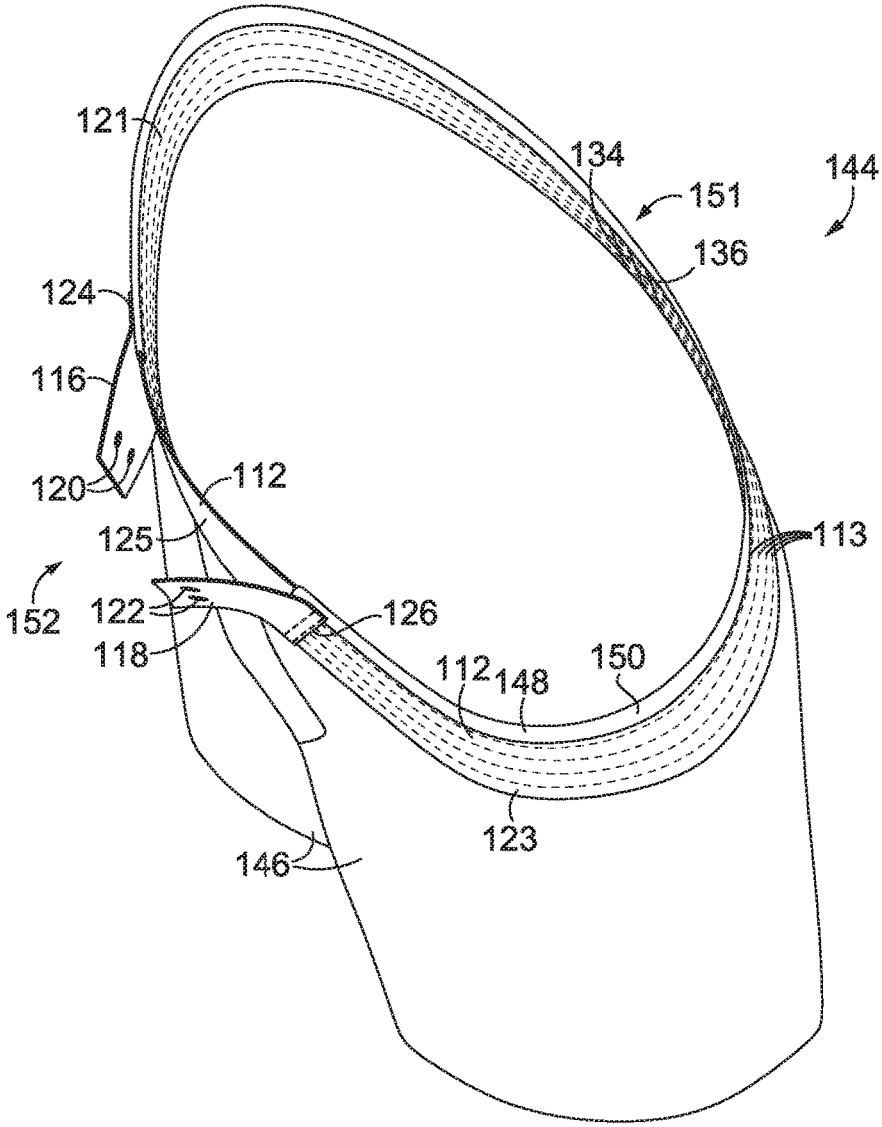
FIG. 16 depicts an angled, perspective view of the article of apparel shown in FIGS. 14A-14B, in accordance with an aspect hereof.

Referring to FIG. 16, a perspective view of the article of apparel 144 shown in FIGS. 14A-14B is provided, in accordance with an aspect hereof. FIG. 16 in particular shows the construction of the waistband 145, which is integrated with the leg portions 146 to form the article of apparel 144 worn by a wearer. FIG. 16 also shows how the first end 134 and the second end 136 of the elastic trim 111 are secured to each other at a rear area 151 of the waistband 145. The third section 125 of the knitted elastic trim 111 modified as shown in FIGS. 13A-13D is positioned to form the front portion 152 of the waistband 145, where it imparts an increased stretch characteristic. This arrangement of the modified elastic trim 111 in the waistband 145 provides increased stretch characteristics to the front portion 152 of the waistband 145 compared to the other portions of the waistband 145 formed by the first and second sections 121, 123 of the modified elastic trim 111. This may provide increased comfort, flexibility, and adjustability for a wearer of the article of apparel 144, among other benefits.

Figure 17:
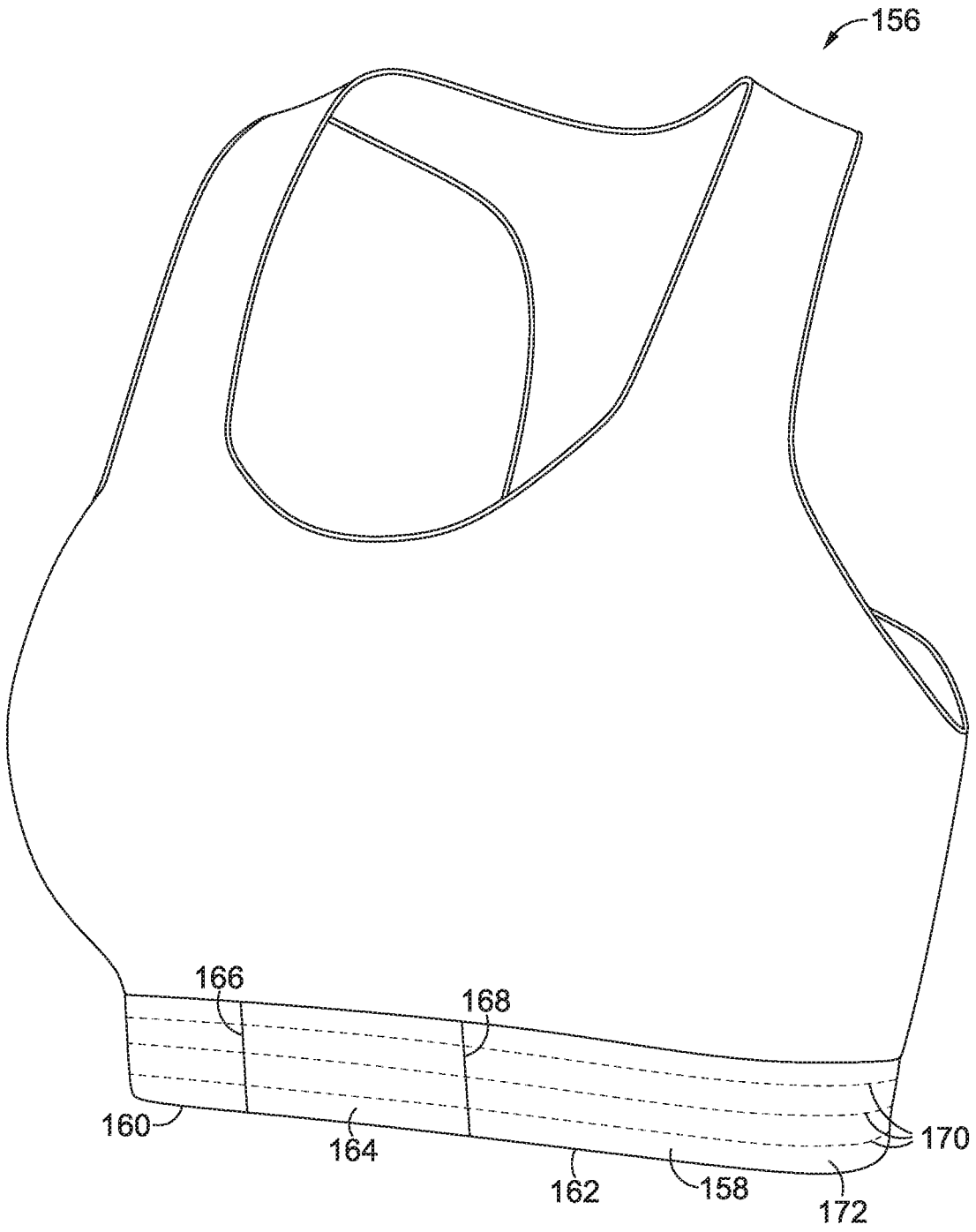
FIG. 17 depicts an example upper body article of apparel with an integrated elastic trim, in accordance with an aspect hereof.

Referring now to FIG. 17, an upper body article of apparel 156 with an elastic trim 158 incorporated is provided, in accordance with an aspect hereof. The elastic trim 158 may be similar to the elastic trim 10 shown in FIGS. 3A and 3B or to another aspect described herein. The elastic trim 158 includes a first section 160 (which is partially obscured in FIG. 17) that has a first longitudinal length extending along part of a continuous circumference formed by the elastic trim 158, a second section 162 (which is partially obscured in FIG. 17) that has a second longitudinal length extending along part of the continuous circumference formed by the elastic trim 158, and a third section 164 that has a third longitudinal length extending along part of the continuous circumference formed by the elastic trim 158. The first, second, and third sections 160, 162, 164 are integrally formed with each other as described with respect to the aspect depicted in FIGS. 3A and 3B. Specifically, the first section 160 extends integrally from a first end 166 of the third section 164 and the second section 162 extends integrally from a second end 168 of the third section 164 as shown in FIG. 17. The ends of the elastic trim (not shown) are coupled together at a location on the elastic trim that is circumferentially spaced from the third section 164 (i.e., at the rear portion of the upper body article of apparel 156).

The elastic trim 158 integrated with the article of apparel 156 is constructed and/or modified to exhibit variable stretch characteristics, like the elastic trim 10 of FIGS. 3A and 3B. The elastic trim 158 includes a base textile 172, which may be formed of materials that have elastomeric properties (e.g., one or more elastomeric yarns or fibers). The first, second, and third sections 160, 162, 164 of the elastic trim 158 also include a plurality of tunnel structures 170 formed in the base textile 172. The tunnel structures 170 integrally extend about the continuous circumference formed by the elastic trim 158. The tunnel structures 170 each include one or more cables movably positioned therein (the cables are not visible in the aspect depicted in FIG. 17; however, in aspects in which apertures are provided in the tunnel structures 170, portions of such cables may be exposed and/or move into and out of the tunnel structures 170 to accommodate a changing length of the elastic trim 158). The cables extending through the tunnel structures 170 are secured at least at the first end 166 and at the second end 168 of the third section 164. The cables are also absent from the tunnel structures 170 in the third section 164 of the elastic trim 158. The cables as discussed herein exhibit lower elastomeric properties than the base textile 172, or in other words, the base textile 172 has a higher stretch characteristic than the cables positioned in the tunnel structures 170. As a result, the third section 164 exhibits higher stretch than the remaining first and second sections 160, 162. The additional stretch provided in this section may provide greater comfort, flexibility, and adjustability for the wearer of the article of apparel 156.

FIG. 17 depicts the elastic trim 158 incorporated for example purposes into a bra. However, it is contemplated that any elastic trim described herein, including the elastic trim 158 shown in FIG. 17, may be incorporated into a variety of different upper body articles of apparel, such as a shirt, hoodie, jacket, form-fitting upper body layer, pullover, or other form of apparel or accessory, or a cuff or waist opening of the same. Accordingly, the upper body article of apparel 156 shown in FIG. 17 is presented only as one non-limiting example, and other combinations of elastic trims and upper body articles are contemplated as within the scope of the present disclosure.

Figure 18A:
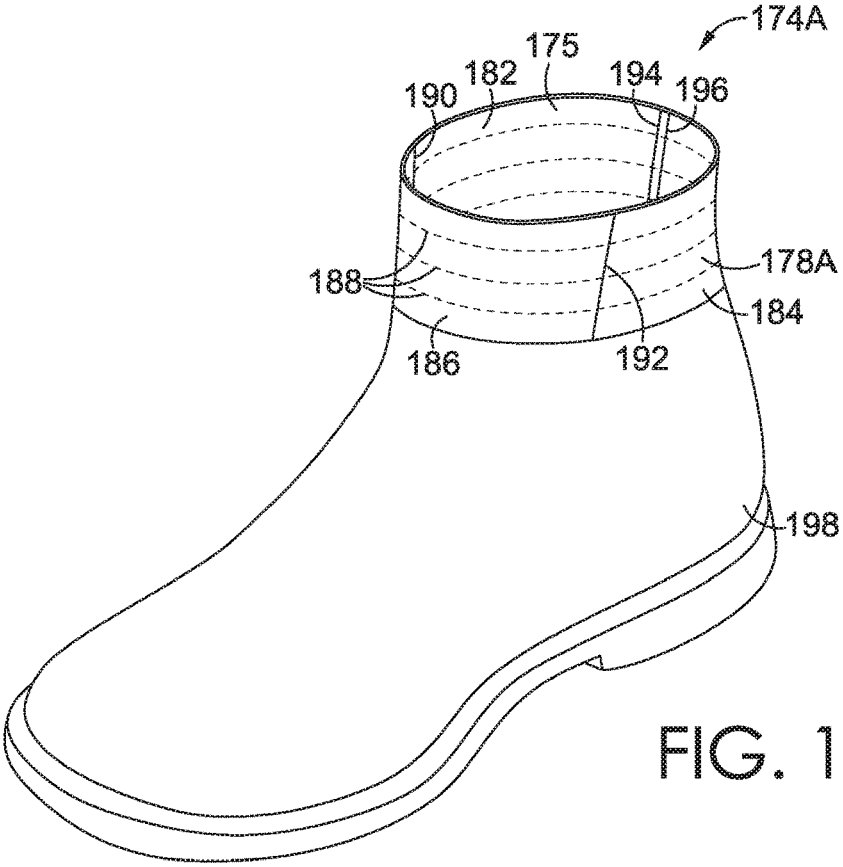
FIG. 18A depicts an example article of footwear with an integrated elastic trim, in accordance with an aspect hereof
Figure 18B:
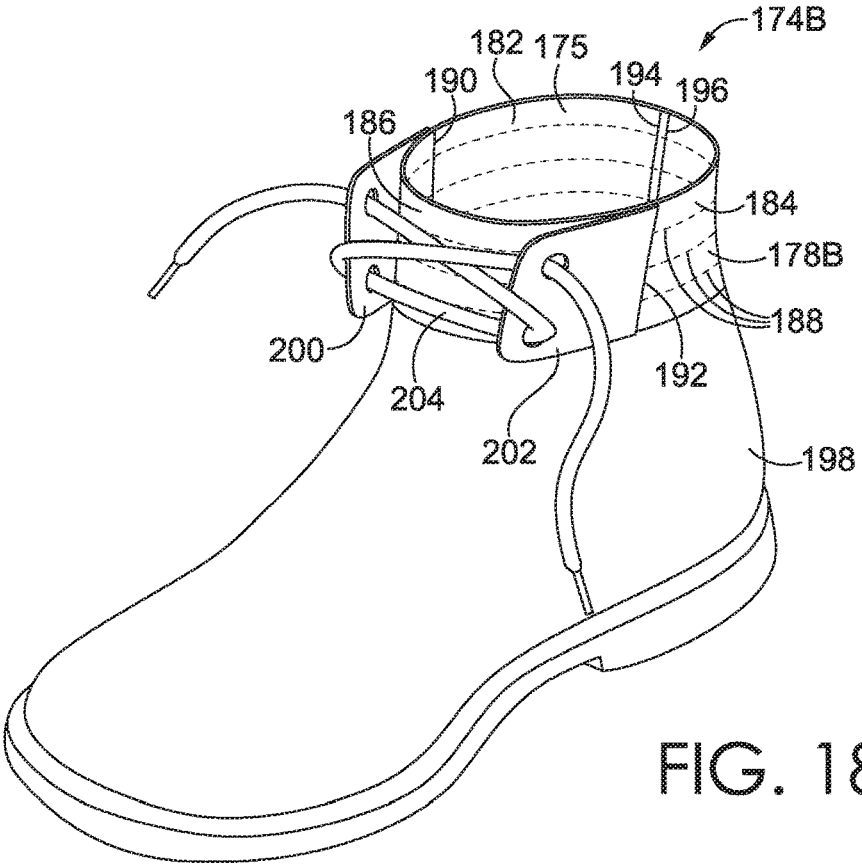
FIG. 18B depicts the article of footwear of FIG. 18A with another integrated elastic trim, in accordance with an aspect hereof.

Referring now to FIGS. 18A-18B, example articles of footwear 174A, 174B having elastic trims 178A, 178B incorporated therein are provided, in accordance with aspects hereof. The articles of footwear 174A, 174B depicted in FIGS. 18A and 18B are provided as shoes. However, it is contemplated that in other aspects, the articles may instead be socks, boots, or other types of footwear. As shown in FIGS. 18A and 18B, the elastic trims 178A, 178B are each attached to an upper portion 198 of the corresponding article of footwear 174A, 174B, allowing them to be used as a cinching or tightening structure for securing the shoe to a wearer's foot.

The elastic trim 178A depicted in FIG. 18A includes a similar construction to the other elastic trims described herein. Specifically, the elastic trim 178A includes a first section 182 forming a first longitudinal length of the elastic trim 178A, a second section 184 forming a second longitudinal length of the elastic trim 178A, and a third section 186 forming a third longitudinal length of the elastic trim 178A. The first, second, and third sections 182, 184, 186 are integrally formed with each other. The elastic trim 178A includes a base textile 175 that may be formed from a knitted or woven construction as described herein. The base textile 175 may be formed from materials having elastomeric properties as described herein, which provides a stretch characteristic to the base textile 175.

The elastic trim 178A further includes a plurality of tunnel structures 188 integrally extending through the first section 182, the second section 184, and the third section 186. The tunnel structures 188 each include a cable movably positioned therein that extends through part of the tunnel structures 188 extending about a continuous circumference formed by the elastic trim 178A. The cables (which are obscured in FIGS. 18A-18B by the tunnel structures 188, but which may be visible in aspects in which openings are provided in the tunnel structures) extend through the first section 182 and the second section 184 of the elastic trim 178A. The cables are secured at a first end 190 and a second end 192 of the third section 186 of the elastic trim 178A. The cables are also absent from the third section 186 of the elastic trim 178A. The cables may have been removed using one of the processing operations described herein. The absence of the cables from the third section 186 of the elastic trim 178A imparts a greater stretch characteristic to the third section 186. This allows the elastic trim 178A forming the foot-receiving opening of the article of footwear 174A to help retain the article of footwear 174A against a wearer's foot when worn.

Prior to integrating the elastic trim 178A with the article of footwear 174A, the elastic trim 178A may be manufactured and/or otherwise provided as one of a plurality of repeating sections in a length of elastic trim, like the aspect shown in FIGS. 2A and 2B. In this circumstance, the elastic trim 178A may be removed and attached to itself at opposite ends to form a continuous circumference, and the continuous circumference may then be attached or otherwise integrated into the article of footwear 174A.

Referring to FIG. 18B, an article of footwear 174B with an elastic trim 178B that is similar to the elastic trim 178A shown in FIG. 18A, but with the addition of tabs 200, 202 and a lanyard 204, is shown, in accordance with an aspect hereof. The tab 200 is coupled to a first end 190 of the third section 186 of the elastic trim 178B, thereby securing the cables in the tunnel structures 188 at that location. The tab 202 is coupled to the second end 192 of the third section 186, thereby securing the cables in the tunnel structures 188 at that location. These tabs 200, 202 allow a wearer to pull the lanyard 204, applying a tension to the elastic trim 178B through the attachments at the first and second ends 190, 192. This tension is transferred to the base textile 175 and to the cables in the tunnel structures 188 which have a lower stretch characteristic than the materials used to form the base textile 175. The cables can thus apply a tension to a portion of the wearer's body to hold the article of footwear 174B in place.

Figure 19:
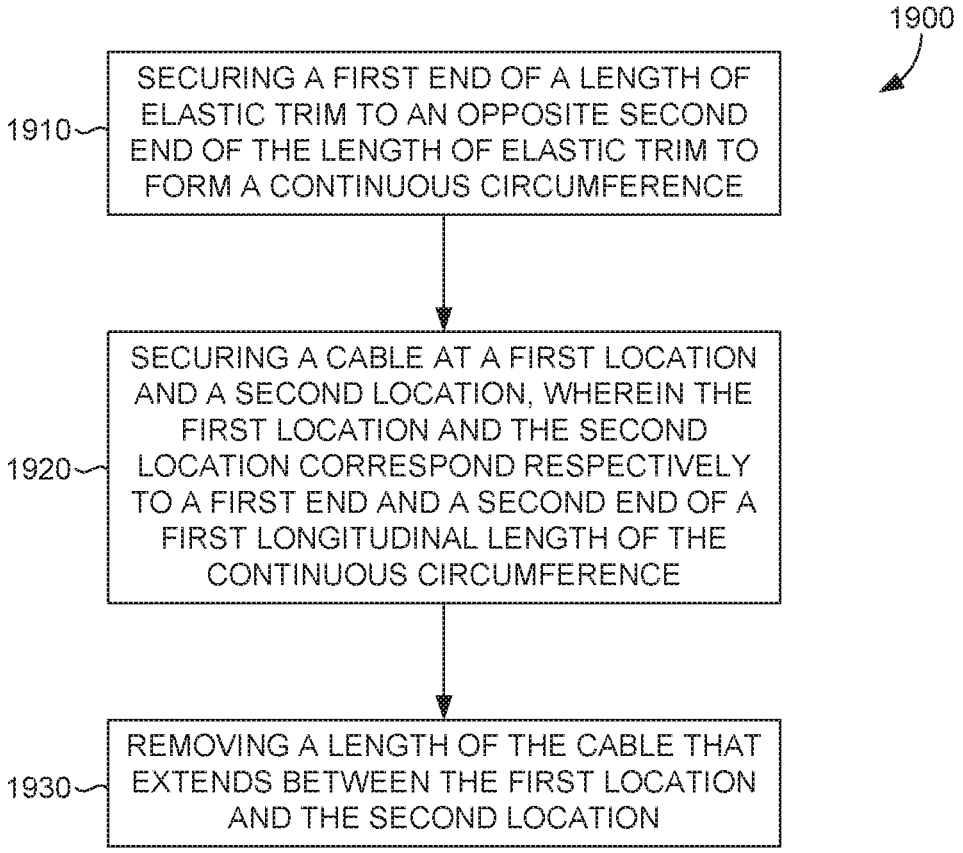
FIG. 19 depicts a block diagram of an example method of processing a length of elastic trim, in accordance with an aspect hereof.

Referring to FIG. 19, a block diagram of an example method 1900 for processing a length of elastic trim is provided, in accordance with an aspect hereof. At block 1910, a first end of a length of elastic trim, such as the first end 12 of the length of elastic trim 10 shown in FIG. 1, is secured to an opposite second end of the length of elastic trim, such as the second end 14 of the length of elastic trim 10 shown in FIG. 1, to form a continuous circumference, such as the continuous circumference 15 shown in FIG. 3B. At block 1920, a cable, such as the cable 64 shown in FIG. 4A, is secured at a first location and a second location. The first location and the second location correspond respectively to a first end and a second end of a first longitudinal length, such as the first end 28 and the second end 30 of the third section 24 shown in FIG. 3B, of the continuous circumference. At block 1930, a length of the cable, such as the cable 64 shown in FIG. 4A, that extends between the first location and the second location is removed.

In one aspect hereof, a trim piece forming a continuous circumference is provided. The trim piece includes a textile layer having a first section extending along a first longitudinal length of the trim piece and a second section extending along a remaining second longitudinal length of the trim piece, the second section integrally extending from the first section to form the continuous circumference, where at least one tunnel structure extends along the first longitudinal length of the first section, a non-elastomeric cable is movably positioned within the at least one tunnel structure, and the non-elastomeric cable terminates and is secured at a first end and a second end of the second section such that the non-elastomeric cable is absent from the second section.

In another aspect hereof, a woven trim piece forming a continuous circumference and having a first surface and an opposite second surface is provided. The woven trim piece includes a first section extending along a first longitudinal length of the woven trim piece and a second section extending along a remaining second longitudinal length of the woven trim piece, the second section integrally extending from the first section to form the continuous circumference, where at least one tunnel structure extends along the first longitudinal length of the first section, a non-elastomeric cable is movably positioned within the at least one tunnel structure, and the non-elastomeric cable terminates and is secured at a first end and a second end of the second section such that the non-elastomeric cable is absent from the second section.

In another aspect hereof, a knit trim piece forming a continuous circumference and having a first surface and an opposite second surface is provided. The knit trim piece includes a first section extending along a first longitudinal length of the knit trim piece and a second section extending along a remaining second longitudinal length of the knit trim piece, the second section integrally extending from the first section to form the continuous circumference, where at least one tunnel structure extends along the first longitudinal length of the first section and along the second longitudinal length of the second section, and the knit trim piece further includes a non-elastomeric cable that is movably positioned within the at least one tunnel structure as it extends along the first longitudinal length of the first section, and the non-elastomeric cable terminates and is secured at a first end and a second end of the second section such that the non-elastomeric cable is absent from the second section.

In another aspect hereof, a lower body article of apparel is provided. The lower body article of apparel includes a front portion and a back portion that together define at least a waist opening, a first leg opening, and a second leg opening, and a knit waistband having a first surface and an opposite second surface, the knit waistband coupled to the waist opening of the lower-body article of apparel, the knit waistband comprising a first section extending along a first longitudinal length of the knit waistband and a second section extending along a remaining second longitudinal length of the knit waistband, the second section integrally extending from the first section, where at least one tunnel structure extends along the first longitudinal length of the first section and along the second longitudinal length of the second section, and a non-elastomeric cable is movably positioned within the at least one tunnel structure as it extends along the first longitudinal length of the first section, and the non-elastomeric cable terminates and is secured at a first end and a second end of the second section such that the non-elastomeric cable is absent from the second section.

In another aspect hereof, a lower body article of apparel is provided. The lower body article of apparel includes a front portion and a back portion that together define at least a waist opening, a first leg opening, and a second leg opening, and a woven waistband having a first surface and an opposite second surface, the woven waistband coupled to the waist opening of the lower body article of apparel, the woven waistband comprising a first section extending along a first longitudinal length of the woven waistband and a second section extending along a remaining second longitudinal length of the woven waistband, the second section integrally extending from the first section, wherein at least one tunnel structure extends along the first longitudinal length of the first section, and a non-elastomeric cable is movably positioned within the at least one tunnel structure, and the non-elastomeric cable terminates and is secured at a first end and a second end of the second section such that the non-elastomeric cable is absent from the second section.

In another aspect hereof, a method for forming a knit waistband is provided. The method comprises forming a length of knit textile into a circumferential shape, where the length of the knit textile is at least partially formed from one or more elastomeric yarns, where the length of the knit textile includes at least one tunnel structure that extends along the length of the knit textile, where a non-elastomeric cable is positioned in the at least one tunnel structure, securing a first end of the length of the knit textile to an opposite second end of the length of the knit textile to form a continuous circumference of the knit waistband, securing the non-elastomeric cable at a first location and a second location, where the first location and the second location correspond respectively to a first end and a second end of a longitudinal section of the continuous circumference of the knit waistband, and removing a length of the non-elastomeric cable that extends between the first location and the second location.

In another aspect hereof, a method for forming a woven waistband is provided. The method includes forming a length of woven textile into a circumferential shape, where the length of the woven textile is at least partially formed from one or more elastomeric yarns and includes a first longitudinal section and a second longitudinal section, the first longitudinal section comprising a first woven layer, a second woven layer, and a third woven layer that are interwoven at one or more first areas, the second longitudinal section comprising the first woven layer and the second woven layer interwoven at one or more second areas without the third woven layer being interwoven with the first woven layer and the second woven layer, such that the third woven layer is detached from the first woven layer and the second woven layer, where a tunnel structure extends between the first woven layer and the second woven layer, and wherein a non-elastomeric cable is positioned in the tunnel structure, securing a first end of the length of the woven textile to an opposite second end of the length of the woven textile to form a continuous circumference of the woven waistband, securing the non-elastomeric cable at a first location and a second location, where the first location and the second location correspond respectively to a first end and a second end of the second longitudinal section of the length of the woven textile, and removing a length of the non-elastomeric cable that extends between the first location and the second location.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are non-limiting.

Clause 1. An elastic trim, comprising:

a first woven section forming a first longitudinal length of the elastic trim;

a second woven section forming a second longitudinal length of the elastic trim;

a third woven section forming a third longitudinal length of the elastic trim, the third woven section interposed between the first woven section and the second woven section, the first woven section and the second woven section integrally extending from opposite ends of the third woven section;

at least one tunnel structure extending through the first woven section, the second woven section, and the third woven section; and a cable movably positioned within the at least one tunnel structure, wherein the first woven section and the second woven section each comprise a first woven layer, a second woven layer, and a third woven layer that are interwoven with each other at one or more first areas.

Clause 2. The elastic trim of clause 1, wherein the cable is non-elastomeric.

Clause 3. The elastic trim of any of the preceding clauses, wherein the first woven section, the second woven section, and the third woven section form a repeating sequence along a length of the elastic trim.

Clause 4. The elastic trim of any of the preceding clauses, wherein the first woven section, the second woven section, and the third woven section each comprise an elastomeric yarn, wherein the elastomeric yarn comprises a first diameter, and wherein the cable comprises a second diameter that is larger than the first diameter.

Clause 5. The elastic trim of any of the preceding clauses, wherein the third woven section comprises the first woven layer and the second woven layer interwoven at one or more second areas without the third woven layer being interwoven with the first woven layer and the second woven layer, such that the third woven layer is detached from the first woven layer and the second woven layer at the third woven section.

Clause 6. The elastic trim of any of the preceding clauses, wherein the at least one tunnel structure is formed between the first woven layer and the second woven layer.

Clause 7. The elastic trim of any of the preceding clauses, wherein both the first longitudinal length of the first woven section and the second longitudinal length of the second woven section are greater than the third longitudinal length of the third woven section.

Clause 8. The elastic trim of any of the preceding clauses, wherein the elastic trim comprises a portion of an article of apparel.

Clause 9. The elastic trim of clause 8, wherein the article of apparel comprises a lower-body article of apparel, and wherein the elastic trim comprises a waistband of the lower-body article of apparel.

Clause 10. The elastic trim of clause 8, wherein the article of apparel is an upper-body article of apparel, and wherein the elastic trim comprises an under-band of the upper-body article of apparel.

Clause 11. The elastic trim of any of clauses 1 through 8, wherein the elastic trim comprises a portion of an article of footwear.

Clause 12. An elastic trim, comprising:

a first section forming a first longitudinal length of the elastic trim;

a second section forming a second longitudinal length of the elastic trim;

a third section forming a third longitudinal length of the elastic trim, the third section interposed between the first section and the second section, the first section and the second section integrally extending from opposite first and second ends of the third section;

a first tunnel structure extending through the first section with a first cable movably positioned within the first tunnel structure; and a second tunnel structure extending through the second section with a second cable movably positioned within the second tunnel structure, wherein the first cable terminates and is secured at the first end of the third section and the second cable terminates and is secured at the second end of the third section, and wherein a first end of the first section and a first end of the second section are coupled together such that the elastic trim forms a continuous circumference.

Clause 13. The elastic trim of clause 12, wherein the elastic trim comprises a waistband.

Clause 14. The elastic trim of any of clauses 12 through 13, further comprising a first tab extending outward from a first surface of the elastic trim, the first tab having at least one first aperture, the first tab positioned at the first end of the third section, and a second tab extending outward from the first surface of the elastic trim, the second tab having at least one second aperture, the second tab positioned at the second end of the third section.

Clause 15. The elastic trim of any of clauses 12 through 14, wherein the elastic trim comprises a knitted textile, and wherein the first tunnel structure and the second tunnel structure extend along the third longitudinal length of the third section.

Clause 16. The elastic trim of any of clauses 12 through 14, wherein the elastic trim comprises a woven textile, and wherein the first tunnel structure and the second tunnel structure are absent from the third section.

Clause 17. The elastic trim of clause 16, wherein the first section and the second section each comprise a first woven layer, a second woven layer, and a third woven layer that are interwoven with each other at one or more areas, and wherein the third section comprises the third woven layer without the first woven layer and the second woven layer.

Clause 18. The elastic trim of any of clauses 12 through 17, wherein both the first longitudinal length of the first section and the second longitudinal length of the second section are greater than the third longitudinal length of the third section.

Clause 19. The elastic trim of any of clauses 12 through 18, wherein the elastic trim comprises one or more elastomeric yarns that extend through the first section, the second section, and the third section.

Clause 20. The elastic trim of any of clauses 12 through 19, wherein a diameter of the first cable and a diameter of the second cable are both greater than a diameter of each yarn of the one or more elastomeric yarns.

Clause 21. The elastic trim of any of clauses 12 through 20, wherein the first end of the first section and the first end of the second section are coupled together at a location that is circumferentially spaced from the third section on the continuous circumference.

Clause 22. The elastic trim of any of clauses 12 through 21, wherein the elastic trim comprises an under-band of an upper-body article of apparel.

Clause 23. The elastic trim of any of clauses 12 through 21, wherein the elastic trim comprises at least a portion of an article of footwear.

Clause 24. A method for processing a length of elastic trim, the method comprising:

securing a first end of the length of elastic trim to an opposite second end of the length of elastic trim to form a continuous circumference, wherein the length of elastic trim includes at least one tunnel structure, and wherein a cable is movably positioned within the at least one tunnel structure;

securing the cable at a first location and a second location, wherein the first location and the second location correspond respectively to a first end and a second end of a first longitudinal length of the continuous circumference; and removing a length of the cable that extends between the first location and the second location.

Clause 25. The method for processing the length of elastic trim of clause 24, wherein the cable is non-elastomeric.

Clause 26. The method for processing the length of elastic trim of any of clauses 24 through 25, wherein the length of elastic trim comprises one or more elastomeric yarns.

Clause 27. The method for processing the length of elastic trim of any of clauses 24 through 26, further comprising cutting the length of elastic trim out of a repeating sequence of the elastic trim prior to forming the length of elastic trim into the continuous circumference.

Clause 28. The method for processing the length of elastic trim of any of clauses 24 through 27, wherein the length of elastic trim comprises a knitted textile, and wherein prior to removing the length of the cable extending between the first location and the second location, the length of the cable is positioned external to the at least one tunnel structure.

Clause 29. The method for processing the length of elastic trim of any of clauses 24 through 27, wherein the length of elastic trim comprises a woven textile, and wherein the length of elastic trim comprises a second longitudinal length of the continuous circumference that integrally extends from the first longitudinal length, the second longitudinal length comprising a first woven layer, a second woven layer, and a third woven layer that are interwoven at one or more first areas.

Clause 30. The method for processing the length of elastic trim of clause 29, wherein prior to removing the length of the cable that extends between the first location and the second location of the first longitudinal length, the first longitudinal length of elastic trim comprises the first woven layer and the second woven layer interwoven at one or more second areas without the third woven layer being interwoven with the first woven layer and the second woven layer, such that the third woven layer is detached from the first woven layer and the second woven layer.

Clause 31. The method for processing the length of elastic trim of any of clauses 29 through 30, wherein the at least one tunnel structure is formed between the first woven layer and the second woven layer.

Clause 32. The method for processing the length of elastic trim of any of clauses 29 through 31, wherein removing the length of the cable that extends between the first location and the second location comprises removing the first woven layer and the second woven layer at the first end and at the second end of the first longitudinal length, such that the first woven layer and the second woven layer are absent from the first longitudinal length and the third woven layer extends across the first longitudinal length.

Clause 33. The method for processing the length of elastic trim of any of clauses 24 through 32, further comprising incorporating the length of elastic trim into an article of apparel.

Clause 34. The method for processing the length of elastic trim of clause 33, wherein the article of apparel comprises a lower-body article of apparel, and wherein the length of elastic trim comprises a waistband.

Clause 35. The method for processing the length of elastic trim of clause 33, wherein the article of apparel comprises an upper-body article of aspparel, and wherein the length of elastic trim comprises an under-band.

Clause 36. The method for processing the length of elastic trim of any of clauses 24 through 32, further comprising incorporating the length of elastic trim into an article of footwear.

Many different arrangements of the various components depicted, as well as use of components not shown, are possible without departing from the spirit and scope of the present disclosure. Aspects of the present disclosure have been described with the intent to be illustrative rather than restrictive. Alternative aspects will become apparent to those skilled in the art that do not depart from the scope hereof. A skilled artisan may develop alternative means of implementing the aforementioned aspects without departing from the scope of the present disclosure. It will be understood that certain features and subcombinations are of utility and may be employed without reference to other features and subcombinations and are contemplated as within the scope of the claims.

What is claimed is:

1. A method of manufacturing an elastic trim, the method comprising:

forming a first woven section defining a first longitudinal length of the elastic trim;

forming a second woven section defining a second longitudinal length of the elastic trim;

forming a third woven section defining a third longitudinal length of the elastic trim, the third woven section interposed between the first woven section and the second woven section, the first woven section and the second woven section integrally extending from opposite ends of the third woven section, wherein the first woven section, the second woven section, and the third woven section are formed such that at least one tunnel structure extends through the first woven section, the second woven section, and the third woven section; and movably positioning a cable in the at least one tunnel structure, wherein the first woven section and the second woven section each comprise a first woven layer, a second woven layer, and a third woven layer that are interwoven with each other at one or more first areas, and wherein the third woven section comprises the first woven layer and the second woven layer interwoven at one or more second areas without the third woven layer being interwoven with the first woven layer and the second woven layer, such that the third woven layer is detached from the first woven layer and the second woven layer at the third woven section.

2. The method of manufacturing the elastic trim of claim 1, wherein the first woven section, the second woven section, and the third woven section form a repeating sequence along a length of the elastic trim.

3. The method of manufacturing the elastic trim of claim 1, wherein the cable is non-elastomeric.

4. The method of manufacturing the elastic trim of claim 1, wherein the first woven section, the second woven section, and the third woven section are each formed with at least one elastomeric yarn.

5. The method of manufacturing the elastic trim of claim 1, further comprising removing the third woven layer from the third woven section.

6. The method of manufacturing the elastic trim of claim 5, further comprising integrating the elastic trim into an article of apparel.

7. The method of manufacturing the elastic trim of claim 5, further comprising integrating the elastic trim into an article of footwear.

8. A method of manufacturing an elastic trim, the method comprising:

forming a first section defining a first longitudinal length of the elastic trim;

forming a second section defining a second longitudinal length of the elastic trim;

forming a third section defining a third longitudinal length of the elastic trim, the third section interposed between the first section and the second section, the first section and the second section integrally extending from opposite first and second ends of the third section, wherein a first tunnel structure extends through the first section, and wherein a second tunnel structure extends through the second section;

movably positioning a first cable in the first tunnel structure; and movably positioning a second cable in the second tunnel structure, wherein the first cable terminates and is secured at the first end of the third section and the second cable terminates and is secured at the second end of the third section, wherein a first end of the first section and a first end of the second section are coupled together such that the elastic trim forms a continuous circumference, wherein the first tunnel structure and the second tunnel structure are absent from the third section, wherein the first section and the second section each comprise a first layer, a second layer, and a third layer that are connected at one or more areas, and wherein the third section comprises the third layer without the first layer or the second layer.

9. The method of manufacturing the elastic trim of claim 8, wherein the first section, the second section, and the third section form a repeating sequence along a length of the elastic trim.

10. The method of manufacturing the elastic trim of claim 8, wherein the first cable is non-elastomeric and the second cable is non-elastomeric.

11. The method of manufacturing the elastic trim of claim 8, wherein the first section, the second section, and the third section are each formed with at least one elastomeric yarn.

12. The method of manufacturing the elastic trim of claim 11, wherein the at least one elastomeric yarn comprises a first diameter, and wherein the first cable and the second cable each comprise a corresponding diameter that is larger than the first diameter.

13. The method of manufacturing the elastic trim of claim 8, further comprising integrating the elastic trim into an article of apparel.

14. The method of manufacturing the elastic trim of claim 8, further comprising integrating the elastic trim into an article of footwear.

15. An article of apparel, comprising:

an elastic trim, comprising:

a first woven section forming a first longitudinal length of the elastic trim;

a second woven section forming a second longitudinal length of the elastic trim;

a third woven section forming a third longitudinal length of the elastic trim, the third woven section interposed between the first woven section and the second woven section, the first woven section and the second woven section integrally extending from opposite ends of the third woven section;

at least one tunnel structure extending through the first woven section and the second woven section; and a cable movably positioned within the at least one tunnel structure, wherein the first woven section and the second woven section each comprise a first woven layer, a second woven layer, and a third woven layer that are interwoven with each other at one or more areas, wherein, in the third woven section, the first woven layer and the second woven layer are not interwoven with the third woven layer, and wherein the first woven layer and the second woven layer are removed from the third woven section.

16. The article of apparel of claim 15, wherein the cable is non- elastomeric.

17. The article of apparel of claim 15, wherein the first woven section, the second woven section, and the third woven section are each formed with at least one elastomeric yarn.

18. The article of apparel of claim 15, wherein the article of apparel is a lower body article of apparel.

19. The article of apparel of claim 15, wherein the article of apparel is an upper body article of apparel.

20. The article of apparel of claim 15, further comprising:

a first tab extending outward from a surface of the elastic trim, the first tab having at least one first aperture, the first tab positioned at a first end of the third woven section, and a second tab extending outward from the surface of the elastic trim, the second tab having at least one second aperture, the second tab positioned at a second end of the third woven section.

* * * * *